US010090599B2

(12) United States Patent
Bily et al.

(10) Patent No.: US 10,090,599 B2
(45) **Date of Patent: *Oct. 2, 2018**

(54) SURFACE SCATTERING ANTENNA IMPROVEMENTS

(71) Applicant: Searete LLC, Bellevue, WA (US)

(72) Inventors: Adam Bily, Seattle, WA (US); Jeff Dallas, Kirkland, WA (US); Russell J. Hannigan, Sammamish, WA (US); Nathan Kundtz, Kirkland, WA (US); David R. Nash, Arlington, WA (US); Ryan Allan Stevenson, Woodinville, WA (US)

(73) Assignee: The Invention Science Fund I LLC

( * ) Notice: Subject to any disclaimer, the term of this patent is extended or adjusted under 35 U.S.C. 154(b) by 128 days.

This patent is subject to a terminal disclaimer.

(21) Appl. No.: 15/172,475

(22) Filed: Jun. 3, 2016

(65) Prior Publication Data

US 2016/0359234 A1 Dec. 8, 2016

Related U.S. Application Data

(63) Continuation of application No. 13/838,934, filed on Mar. 15, 2013, now Pat. No. 9,385,435.

(51) Int. Cl.
*H01Q 13/22* (2006.01)
*H01Q 13/28* (2006.01)
(Continued)

(52) U.S. Cl.
CPC ..... *H01Q 13/22* (2013.01); *H01Q 3/22* (2013.01); *H01Q 3/443* (2013.01); *H01Q 13/28* (2013.01)

(58) Field of Classification Search
CPC ..... H01Q 13/20; H01Q 13/26; H01Q 3/44; H01Q 21/068; H01Q 21/061; H01Q 21/65; H01Q 21/24
See application file for complete search history.

(56) References Cited

U.S. PATENT DOCUMENTS 3,001,193 A 9/1961 Marie
3,388,396 A 6/1968 Rope et al.
(Continued)

FOREIGN PATENT DOCUMENTS

CN 103222109 A 7/2013
JP 52-13751 A 2/1977
(Continued)

OTHER PUBLICATIONS

"Aperture", Definition of Aperture by Merriam-Webster; located at http://www.merriam-webster.com/dictionary/aperture: printed by Examiner on Nov. 30, 2016; pp. 1-9; Merriam-Webster, Incorporated.
(Continued)

*Primary Examiner* — Robert Karacsony

(57) ABSTRACT

Surface scattering antennas provide adjustable radiation fields by adjustably coupling scattering elements along a wave-propagating structure. In some approaches, the scattering elements are patch elements. In some approaches, the scattering elements are made adjustable by disposing an electrically adjustable material, such as a liquid crystal, in proximity to the scattering elements. Methods and systems provide control and adjustment of surface scattering antennas for various applications.

34 Claims, 18 Drawing Sheets

(51) Int. Cl.
*H01Q 3/22* (2006.01)
*H01Q 3/44* (2006.01)

(56) References Cited

U.S. PATENT DOCUMENTS

| | | | |
|---|---|---|---|
| 3,714,608 | A | 1/1973 | Barnes et al. |
| 3,757,332 | A | 9/1973 | Tricoles |
| 3,887,923 | A | 6/1975 | Hendrix |
| 4,195,262 | A | 3/1980 | King |
| 4,291,312 | A | 9/1981 | Kaloi |
| 4,305,153 | A | 12/1981 | King |
| 4,489,325 | A | 12/1984 | Bauck et al. |
| 4,509,209 | A | 4/1985 | Itoh et al. |
| 4,672,378 | A | 6/1987 | Drabowitch et al. |
| 4,701,762 | A | 10/1987 | Apostolos |
| 4,780,724 | A | 10/1988 | Sharma et al. |
| 4,832,429 | A | 5/1989 | Nagler |
| 4,874,461 | A | 10/1989 | Sato et al. |
| 4,920,350 | A | 4/1990 | McGuire et al. |
| 4,947,176 | A | 8/1990 | Inatsune et al. |
| 4,978,934 | A | 12/1990 | Saad |
| 5,198,827 | A | 3/1993 | Seaton |
| 5,455,590 | A | 10/1995 | Collins et al. |
| 5,512,906 | A | 4/1996 | Speciale |
| 5,734,347 | A | 3/1998 | McEligot |
| 5,841,543 | A | 11/1998 | Guldi et al. |
| 5,889,599 | A | 3/1999 | Takemori |
| 6,031,506 | A | 2/2000 | Cooley et al. |
| 6,061,023 | A | 5/2000 | Daniel et al. |
| 6,061,025 | A | 5/2000 | Jackson et al. |
| 6,075,483 | A | 6/2000 | Gross |
| 6,084,540 | A | 7/2000 | Yu |
| 6,114,834 | A | 9/2000 | Parise |
| 6,166,690 | A | 12/2000 | Lin et al. |
| 6,198,453 | B1 | 3/2001 | Chew |
| 6,211,823 | B1 | 4/2001 | Herring |
| 6,232,931 | B1 | 5/2001 | Hart |
| 6,236,375 | B1 | 5/2001 | Chandler et al. |
| 6,275,181 | B1 | 8/2001 | Kitayoshi |
| 6,366,254 | B1 | 4/2002 | Sievenpiper et al. |
| 6,384,797 | B1 | 5/2002 | Schaffner et al. |
| 6,396,440 | B1 | 5/2002 | Chen |
| 6,469,672 | B1 | 10/2002 | Marti-Canales et al. |
| 6,545,645 | B1 | 4/2003 | Wu |
| 6,552,696 | B1 | 4/2003 | Sievenpiper et al. |
| 6,633,026 | B2 | 10/2003 | Tuominen |
| 6,985,107 | B2 | 1/2006 | Anson et al. |
| 7,068,234 | B2 | 6/2006 | Sievenpiper |
| 7,151,499 | B2 | 12/2006 | Avakian et al. |
| 7,154,451 | B1 | 12/2006 | Sievenpiper |
| 7,162,250 | B2 | 1/2007 | Misra |
| 7,253,780 | B2 | 8/2007 | Sievenpiper |
| 7,295,146 | B2 | 11/2007 | McMakin et al. |
| 7,307,596 | B1 | 12/2007 | West |
| 7,339,521 | B2 | 3/2008 | Scheidemann et al. |
| 7,428,230 | B2 | 9/2008 | Park |
| 7,456,787 | B2 | 11/2008 | Manasson et al. |
| 7,609,223 | B2 | 10/2009 | Manasson et al. |
| 7,667,660 | B2 | 2/2010 | Manasson et al. |
| 7,830,310 | B1 | 11/2010 | Sievenpiper et al. |
| 7,834,795 | B1 | 11/2010 | Dudgeon et al. |
| 7,864,112 | B2 | 1/2011 | Monosson et al. |
| 7,911,407 | B1 | 3/2011 | Fong et al. |
| 7,929,147 | B1 | 4/2011 | Fong et al. |
| 7,995,000 | B2 | 8/2011 | Manasson et al. |
| 8,009,116 | B2 | 8/2011 | Peichl et al. |
| 8,014,050 | B2 | 9/2011 | McGrew |
| 8,040,586 | B2 | 10/2011 | Smith et al. |
| 8,059,051 | B2 | 11/2011 | Manasson et al. |
| 8,134,521 | B2 | 3/2012 | Herz et al. |
| 8,179,331 | B1 | 5/2012 | Sievenpiper |
| 8,212,739 | B2 | 7/2012 | Sievenpiper |
| 8,339,320 | B2 | 12/2012 | Sievenpiper |
| 8,456,360 | B2 | 6/2013 | Manasson et al. |
| 9,231,303 | B2 | 1/2016 | Edelmann et al. |
| 9,268,016 | B2 | 2/2016 | Smith et al. |
| 9,385,435 | B2 * | 7/2016 | Bily ..... H01Q 13/22 |
| 9,389,305 | B2 | 7/2016 | Boufounos |
| 9,450,310 | B2 * | 9/2016 | Bily ..... H01Q 13/28 |
| 9,634,736 | B2 | 4/2017 | Mukherjee et al. |
| 2002/0039083 | A1 | 4/2002 | Taylor et al. |
| 2002/0167456 | A1 | 11/2002 | McKinzie, III |
| 2003/0214443 | A1 | 11/2003 | Bauregger et al. |
| 2004/0227668 | A1 | 11/2004 | Sievenpiper |
| 2004/0263408 | A1 | 12/2004 | Sievenpiper et al. |
| 2005/0031295 | A1 | 2/2005 | Engheta et al. |
| 2005/0088338 | A1 | 4/2005 | Masenten et al. |
| 2006/0065856 | A1 | 3/2006 | Diaz et al. |
| 2006/0114170 | A1 | 6/2006 | Sievenpiper |
| 2006/0116097 | A1 | 6/2006 | Thompson |
| 2006/0132369 | A1 | 6/2006 | Robertson et al. |
| 2006/0187126 | A1 | 8/2006 | Sievenpiper |
| 2007/0085757 | A1 | 4/2007 | Sievenpiper |
| 2007/0103381 | A1 | 5/2007 | Upton |
| 2007/0159395 | A1 | 7/2007 | Sievenpiper et al. |
| 2007/0159396 | A1 | 7/2007 | Sievenpiper et al. |
| 2007/0176846 | A1 | 8/2007 | Vazquez et al. |
| 2007/0182639 | A1 | 8/2007 | Sievenpiper et al. |
| 2007/0200781 | A1 | 8/2007 | Ahn et al. |
| 2007/0229357 | A1 | 10/2007 | Zhang et al. |
| 2008/0020231 | A1 | 1/2008 | Yamada et al. |
| 2008/0165079 | A1 | 7/2008 | Smith et al. |
| 2008/0180339 | A1 | 7/2008 | Yagi |
| 2008/0224707 | A1 | 9/2008 | Wisler et al. |
| 2008/0259826 | A1 | 10/2008 | Struhsaker |
| 2008/0268790 | A1 | 10/2008 | Shi et al. |
| 2008/0316088 | A1 | 12/2008 | Pavlov et al. |
| 2009/0002240 | A1 | 1/2009 | Sievenpiper et al. |
| 2009/0045772 | A1 | 2/2009 | Cook et al. |
| 2009/0109121 | A1 | 4/2009 | Herz et al. |
| 2009/0147653 | A1 | 6/2009 | Waldman et al. |
| 2009/0195361 | A1 | 8/2009 | Smith |
| 2009/0251385 | A1 | 10/2009 | Xu et al. |
| 2010/0066629 | A1 | 3/2010 | Sievenpiper |
| 2010/0073261 | A1 | 3/2010 | Sievenpiper |
| 2010/0079010 | A1 | 4/2010 | Hyde et al. |
| 2010/0109972 | A2 | 5/2010 | Xu et al. |
| 2010/0134370 | A1 | 6/2010 | Oh et al. |
| 2010/0156573 | A1 | 6/2010 | Smith et al. |
| 2010/0157929 | A1 | 6/2010 | Karabinis |
| 2010/0188171 | A1 | 7/2010 | Mohajer-Iravani et al. |
| 2010/0279751 | A1 | 11/2010 | Pourseyed et al. |
| 2010/0328142 | A1 | 12/2010 | Zoughi et al. |
| 2011/0065448 | A1 | 3/2011 | Song et al. |
| 2011/0098033 | A1 | 4/2011 | Britz et al. |
| 2011/0117836 | A1 | 5/2011 | Zhang et al. |
| 2011/0128714 | A1 | 6/2011 | Terao et al. |
| 2011/0151789 | A1 | 6/2011 | Viglione et al. |
| 2011/0267664 | A1 | 11/2011 | Kitamura et al. |
| 2012/0026068 | A1 | 2/2012 | Sievenpiper |
| 2012/0038317 | A1 | 2/2012 | Miyamoto et al. |
| 2012/0112543 | A1 | 5/2012 | van Wageningen et al. |
| 2012/0194399 | A1 | 8/2012 | Bily et al. |
| 2012/0219249 | A1 | 8/2012 | Pitwon |
| 2012/0268340 | A1 | 10/2012 | Capozzoli et al. |
| 2012/0274147 | A1 | 11/2012 | Stecher et al. |
| 2012/0280770 | A1 | 11/2012 | Abhari et al. |
| 2012/0326660 | A1 | 12/2012 | Lu et al. |
| 2013/0069865 | A1 | 3/2013 | Hart |
| 2013/0082890 | A1 | 4/2013 | Wang et al. |
| 2013/0237272 | A1 | 9/2013 | Prasad |
| 2013/0249310 | A1 | 9/2013 | Hyde et al. |
| 2013/0278211 | A1 | 10/2013 | Cook et al. |
| 2013/0288617 | A1 | 10/2013 | Kim et al. |
| 2013/0324076 | A1 | 12/2013 | Harrang |
| 2013/0343208 | A1 | 12/2013 | Sexton et al. |
| 2014/0128006 | A1 | 5/2014 | Hu |
| 2014/0266946 | A1 | 9/2014 | Bily et al. |
| 2015/0189568 | A1 | 7/2015 | Stanze et al. |
| 2015/0280444 | A1 | 10/2015 | Smith et al. |

(56) References Cited

U.S. PATENT DOCUMENTS

| | | | |
|---|---|---|---|
| 2017/0098961 | A1 | 4/2017 | Harpham |
| 2017/0250746 | A1 | 8/2017 | Wang et al. |

FOREIGN PATENT DOCUMENTS

| | | | |
|---|---|---|---|
| JP | 06-090110 | | 3/1994 |
| JP | 2007-081825 | A | 3/2007 |
| JP | 2008-054146 | A | 3/2008 |
| JP | 2010-187141 | A | 8/2010 |
| JP | 2012085145 | A | 4/2012 |
| KR | 10-1045585 | B1 | 6/2011 |
| WO | WO 01/73891 | A1 | 10/2001 |
| WO | WO 2008-007545 | A1 | 1/2008 |
| WO | WO 2008/059292 | A2 | 5/2008 |
| WO | WO 2009/103042 | | 8/2009 |
| WO | WO 2009/103042 | A2 | 8/2009 |
| WO | WO 2010/0021736 | | 2/2010 |
| WO | WO 2012/050614 | A1 | 4/2012 |
| WO | PCT/US2013/212504 | | 6/2013 |
| WO | WO 2013/147470 | A1 | 10/2013 |

OTHER PUBLICATIONS

PCT International Preliminary Report on Patentability; International App. No. PCT/US2014/070645; dated Jun. 21, 2016; pp. 1-12.

PCT International Search Report; International App. No. PCT/US2016/037667; dated Sep. 7, 2016; pp. 1-3.

Ayob et al.; "A Survey of Surface Mount Device Placement Machine Optimisation: Machine Classification"; Computer Science Technical Report No. NOTTCS-TR-2005-8; Sep. 2005; pp. 1-34.

Canadian Intellectual Property Office, Canadian Examination Search Report, Pursuant to Subsection 30(2); App. No. 2,814,635; dated Dec. 1, 2016; pp. 1-3.

European Patent Office, Supplementary European Search Report, Pursuant to Rule 62 EPC; App. No. EP 14891152; dated Jul. 20, 2017; pp. 1-4.

Supplementary European Search Report, Pursuant to Rule 62 EPC; App. No. EP 14 87 2595; dated Jul. 3, 2017; pp. 1-16.

Supplementary European Search Report, Pursuant to Rule 62 EPC; App. No. EP 14 87 2874; dated Jul. 3, 2017; pp. 1-15.

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

Chen, Robert; *Liquid Crystal Displays*, Wiley, New Jersey 2011 (not provided).

Chin J.Y. et al.; "An efficient broadband metamaterial wave retarder"; Optics Express; vol. 17, No. 9; p. 7640-7647; 2009.

Chu R.S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.

Colburn et al.; "Adaptive Artificial Impedance Surface Conformal Antennas"; in Proc. IEEE Antennas and Propagation Society Int. Symp.; 2009; p. 1-4.

Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.

Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.

Den Boer, Wilem; *Active Matrix Liquid Crystal Displays*; Elsevier, Burlington, MA, 2009 (not provided).

Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.

Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.

Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.

Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.

Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.

Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.

Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.

Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.

Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.

Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.

PCT International Search Report; International App. No. PCT/US2011/001755; dated Mar. 22, 2012; pp. 1-5.

Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.

Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.

Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.

Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.

Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.

Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.

Weil, Carsten et al.; "Tunable Inverted-Microstrip Phase Shifter Device Using Nematic Liquid Crystals"; IEEE MTT-S Digest; 2002; p. 367-370; IEEE.

Yan, Dunbao et al.; "A Novel Polarization Convert Surface Based on Artificial Magnetic Conductor"; Asia-Pacific Microwave Conference Proceedings, 2005.

Yee, Hung Y.; "Impedance of a Narrow Longitudinal Shunt Slot in a Slotted Waveguide Array"; IEEE Transactions on Antennas and Propagation; Jul. 1974; p. 589-592; IEEE.

Young et al.; "Meander-Line Polarizer"; IEEE Trans. Ant. Prop.; p. 376-378; May 1973.

Zhong, S.S. et al.; "Compact ridge waveguide slot antenna array fed by convex waveguide divider"; Electronics Letters; Oct. 13, 2005; p. 1-2; vol. 41, No. 21; IEEE.

Amineh et al.; "Three-Dimensional Near-Field Microwave Holography for Tissue Imaging"; International Journal of Biomedical

(56) References Cited

OTHER PUBLICATIONS

Imaging; Bearing a date of Dec. 21, 2011; pp. 1-11; vol. 2012, Article ID 291494; Hindawi Publishing Corporation.
Belloni, Fabio; "Channel Sounding"; S-72.4210 PG Course in Radio Communications; Bearing a date of Feb. 7, 2006; pp. 1-25.
Diaz, Rudy; "Fundamentals of EM Waves"; Bearing a date of Apr. 4, 2013; 6 Total Pages; located at: http://www.microwaves101.com/encyclopedia/absorbingradar1.cfm.
Frenzel, Lou; "What's the Difference Between EM Near Field and Far Field?"; Electronic Design; Bearing a date of Jun. 8, 2012; 7 Total Pages; located at: http://electronicdesign.com/energy/what-s-difference -between-em-near-field-and-far-field.
Grbic, Anthony; "Electrical Engineering and Computer Science"; University of Michigan; Created on Mar. 18, 2014, printed on Jan. 27, 2014; pp. 1-2; located at: http://sitemaker.umich.edu/agrbic/projects.
Grbic et al.; "Metamaterial Surfaces for Near and Far-Field Applications"; 7th European Conference on Antennas and Propagation (EUCAP 2013); Bearing a date of 2013, Created on Mar. 18, 2014; pp. 1-5.
Imani, et al.; "A Concentrically Corrugated Near-Field Plate"; Bearing a date of 2010, Created on Mar. 18, 2014; pp. 1-4; IEEE.
Imani, et al.; "Design of a Planar Near-Field Plate"; Bearing a date of 2012, Created on Mar. 18, 2014; pp. 1-2; IEEE.
Imani, et al.; "Planar Near-Field Plates"; Bearing a date of 2013, Created on Mar. 18, 2014; pp. 1-10; IEEE.
Islam et al.; "A Wireless Channel Sounding System for Rapid Propagation Measurements"; Bearing a date of Nov. 21, 2012; 7 Total Pages.
Konishi, Yohei; "Channel Sounding Technique Using MIMO Software Radio Architecture"; 12th MCRG Joint Seminar; Bearing a date of Nov. 18, 2010; 28 Total Pages.
Lipworth et al.; "Magnetic Metamaterial Superlens for Increased Range Wireless Power Transfer"; Scientific Reports; Bearing a date of Jan. 10, 2014; pp. 1-6; vol. 4, No. 3642.
Manasson et al.; "Electronically Reconfigurable Aperture (ERA): A New Approach for Beam-Steering Technology"; Bearing dates of Oct. 12-15, 2010; pp. 673-679; IEEE.
Mitri, F.G.; "Quasi-Gaussian Electromagnetic Beams"; Physical Review A.; Bearing a date of Mar. 11, 2013; p. 1; vol. 87, No. 035804; (Abstract Only).
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
Siciliano et al.; "25. Multisensor Data Fusion"; Springer Handbook of Robotics; Bearing a date of 2008, Created on Mar. 18, 2014; 27 Total Pages; Springer.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 Total Pages; Fulton Innovation, LLC.
Wallace, John; "Flat 'Metasurface' Becomes Aberration-Free Lens"; Bearing a date of Aug. 28, 2012; 4 Total Pages; located at: http://www.laserfocusworld.com/articles/2012/08/flat-metasurface-becomes-aberration-free-lens.html.
Yoon et al.; "Realizing Efficient Wireless Power Transfer in the Near-Field Region Using Electrically Small Antennas"; Wireless Power Transfer, Principles and Engineering Explorations; Bearing a date of Jan. 25, 2012, pp. 151-172.
PCT International Search Report; International App. No. PCT/US2014/070645; dated Mar. 16, 2015; pp. 1-3.
PCT International Search Report; International App. No. PCT/US2014/070650; dated Mar. 27, 2015; pp. 1-3.
The State Intellectual Property Office of P.R.C.; Application No. 201180055705.8; dated May 6, 2015; pp. 1-11.
Intellectual Property Office of Singapore Examination Report; Application No. 2013027842; dated Feb. 27, 2015; pp. 1-12.
European Patent Office, Supplementary European Search Report, pursuant to Rule 62 EPC; App. No. EP 11 83 2873; dated May 15, 2014; 7 pages.
Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.
McLean et al.; "Interpreting Antenna Performance Parameters for EMC Applications: Part 2: Radiation Pattern, Gain, and Directivity"; Created on Apr. 1, 2014; pp. 7-17; TDK RF Solutions Inc.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Wavenumber"; Microwave Encyclopedia; Bearing a date of Jan. 12, 2008; pp. 1-2; P-N Designs, Inc.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Jiao, Yong-Chang et al.; A New Low-Side-Lobe Pattern Synthesis Technique for Conformal Arrays; IEEE Transactions on Antennas and Propagation; Jun. 1993; pp. 824-831, vol. 41, No. 6; IEEE.
Ovi et al.; "Symmetrical Slot Loading in Elliptical Microstrip Patch Antennas Partially Filled with Mue Negative Metamaterials"; PIERS Proceedings, Moscow, Russia; Aug. 19-23, 2012; pp. 542-545.
PCT International Search Report; International App. No. PCT/US2014/017454; dated Aug. 28, 2014; pp. 1-4.
PCT International Search Report; International App. No. PCT/US2015/028781; dated Jul. 27, 2015; pp. 1-3.
PCT International Search Report; International App. No. PCT/US2014/061485; dated Jul. 27, 2015; pp. 1-3.
PCT International Search Report; International App. No. PCT/US2015/036638; dated Oct. 19, 2015, pp. 1-4.
Patent Office of the Russian Federation (Rospatent) Office Action; Application No. 2013119332/28(028599); dated Oct. 13, 2015; machine translation; pp. 1-5.
"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.
Crosslink; Summer 2002; pp. 1-56 vol. 3; No. 2; The Aerospace Corporation.
Leveau et al.; "Anti-Jam Protection by Antenna"; GPS World; Feb. 1, 2013; pp. 1-11; North Coast Media LLC; http://gpsworld.com/anti-jam-protection-by-antenna/.
Luo et al.; "High-directivity antenna with small antenna aperture"; Applied Physics Letters; 2009; pp. 193506-1-193506-3; vol. 95; American Institute of Physics.
Smith, David R.; "Recent Progress in Metamaterial and Transformation Optical Design"; NAVAIR Nano/Meta Workshop; Feb. 2-3, 2011; pp. 1-32.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
The State Intellectual Property Office of P.R.C.; Application No. 201180055705.8; Nov. 4, 2015; pp. 1-11.
PCT International Search Report; International App. No. PCT/US2014/069254; dated Nov. 27, 2015; pp. 1-4.
Definition from Merriam-Webster Online Dictionary; "Integral"; Merriam-Webster Dictionary; Dec. 8, 2015; pp. 1-5; located at: http://www.merriam-webster.com/dictionary/integral.
Varlamos et al.; "Electronic Beam Steering Using Switched Parasitic Smart Antenna Arrays"; Progress in Electromagnetics Research; PIER 36; bearing a date of 2002; pp. 101-119.
IP Australia Patent Examination Report No. 1; Patent Application No. 2011314378; dated Mar. 4, 2016; pp. 1-4.

(56) References Cited

OTHER PUBLICATIONS

The State Intellectual Property Office of P.R.C., Fifth Office Action, App. No. 2011/80055705.8 (Based on PCT Patent Application No. PCT/US2011/001755); dated Nov. 16, 2016; pp. 1-3 (machine translation, as provided).
Extended European Search Report; European App. No. EP 14 77 0686; dated Oct. 14, 2016; pp. 1-7.
European Search Report; European App. No. EP 11 832 873.1; dated Sep. 21, 2016; pp. 1-6.
Japan Patent Office, Office Action, App. No. 2016-500314 (based on PCT Patent Application No. PCT/US2014/017454); dated Mar. 6, 2018; pp. 1-4.
European Patent Office, Supplementary European Search Report, Pursuant to Rule 62 EPC; App. No. EP 15 80 8884 ; dated Jan. 9, 2018; pp. 1-12.
Chinese State Intellectual Property Office, First Office Action, App. No. 201480674759.2 (based on PCT Patent Application No. PCT/US2014/069254); Jul. 2, 2013 (received by our Agent on Jul. 8, 2018); pp. 1-14 (machine translation provided).
Smith et al.; "Composite Medium with Simultaneousiy Negative Permemeability and Permitivity"; Physical Review Letters; May 1, 2000; pp. 4184-4187; vol. 84, No. 18; American Physical Society.
European Patent Office, Communication Pursuant to Article 94(3) EPC; App. No. EP 14872874.4; Jul. 16, 2018; pp. 1-8.
European Patent Office, Communication Pursuant to Article 94(3) EPC; App. No. EP 14872595.5; Jul. 16, 2018; pp. 1-7.

* cited by examiner

SURFACE SCATTERING ANTENNA IMPROVEMENTS

CROSS-REFERENCE TO RELATED APPLICATIONS

The present application constitutes a continuation of U.S. patent application Ser. No. 13/838,934, entitled SURFACE SCATTERING ANTENNA IMPROVEMENTS, naming ADAM BILY, JEFF DALLAS, RUSSELL J. HANNIGAN, NATHAN KUNDTZ, DAVID R. NASH, and RYAN ALLAN STEVENSON as inventors, filed MAR. 15, 2013.

U.S. Patent Application No. 61/455,171, entitled SURFACE SCATTERING ANTENNAS, naming NATHAN KUNDTZ ET AL. as inventors, filed Oct. 15, 2010, is related to the present application.

U.S. patent application Ser. No. 13/317,338, entitled SURFACE SCATTERING ANTENNAS, naming ADAM BILY, ANNA K. BOARDMAN, RUSSELL J. HANNIGAN, JOHN HUNT, NATHAN KUNDTZ, DAVID R. NASH, RYAN ALLAN STEVENSON, AND PHILIP A. SULLIVAN as inventors, filed Oct. 14, 2011, is related to the present application.

All subject matter of these Related applications is incorporated herein by reference to the extent such subject matter is not inconsistent herewith.

DETAILED DESCRIPTION

Figure 1:
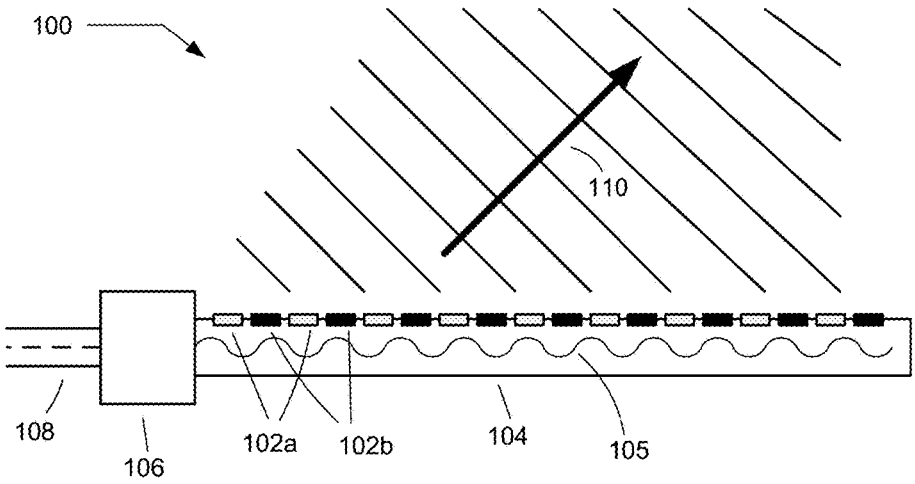
FIG. 1 is a schematic depiction of a surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A schematic illustration of a surface scattering antenna is depicted in FIG. 1. The surface scattering antenna 100 includes a plurality of scattering elements 102*a*, 102*b* that are distributed along a wave-propagating structure 104. The wave propagating structure 104 may be a microstrip, a coplanar waveguide, a parallel plate waveguide, a dielectric slab, a closed or tubular waveguide, or any other structure capable of supporting the propagation of a guided wave or surface wave 105 along or within the structure. The wavy line 105 is a symbolic depiction of the guided wave or surface wave, and this symbolic depiction is not intended to indicate an actual wavelength or amplitude of the guided wave or surface wave; moreover, while the wavy line 105 is depicted as within the wave-propagating structure 104 (e.g. as for a guided wave in a metallic waveguide), for a surface wave the wave may be substantially localized outside the wave-propagating structure (e.g. as for a TM mode on a single wire transmission line or a "spoof plasmon" on an artificial impedance surface). The scattering elements 102*a*, 102*b* may include scattering elements that are embedded within, positioned on a surface of, or positioned within an evanescent proximity of, the wave-propagation structure 104. For example, the scattering elements can include complementary metamaterial elements such as those presented in D. R. Smith et al, "Metamaterials for surfaces and waveguides," U.S. Patent Application Publication No. 2010/0156573, and A. Bily et al, "Surface scattering antennas," U.S. Patent Application Publication No. 2012/0194399, each of which is herein incorporated by reference. As another example, the scattering elements can include patch elements, as discussed below.

The surface scattering antenna also includes at least one feed connector 106 that is configured to couple the wave-propagation structure 104 to a feed structure 108. The feed structure 108 (schematically depicted as a coaxial cable) may be a transmission line, a waveguide, or any other structure capable of providing an electromagnetic signal that may be launched, via the feed connector 106, into a guided wave or surface wave 105 of the wave-propagating structure 104. The feed connector 106 may be, for example, a coaxial-to-microstrip connector (e.g. an SMA-to-PCB adapter), a coaxial-to-waveguide connector, a mode-matched transition section, etc. While FIG. 1 depicts the feed connector in an "end-launch" configuration, whereby the guided wave or surface wave 105 may be launched from a peripheral region of the wave-propagating structure (e.g. from an end of a microstrip or from an edge of a parallel plate waveguide), in other embodiments the feed structure may be attached to a non-peripheral portion of the wave-propagating structure, whereby the guided wave or surface wave 105 may be launched from that non-peripheral portion of the wave-propagating structure (e.g. from a midpoint of a microstrip or through a hole drilled in a top or bottom plate of a parallel plate waveguide); and yet other embodiments may provide a plurality of feed connectors attached to the wave-propagating structure at a plurality of locations (peripheral and/or non-peripheral).

The scattering elements 102*a*, 102*b* are adjustable scattering elements having electromagnetic properties that are adjustable in response to one or more external inputs. Various embodiments of adjustable scattering elements are described, for example, in D. R. Smith et al, previously cited, and further in this disclosure. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), etc. In the schematic example of FIG. 1, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties. Moreover, the particular pattern of adjustment that is depicted in FIG. 1 (i.e. the alternating arrangement of elements 102*a* and 102*b*) is only an exemplary configuration and is not intended to be limiting.

In the example of FIG. 1, the scattering elements 102*a*, 102*b* have first and second couplings to the guided wave or surface wave 105 that are functions of the first and second electromagnetic properties, respectively. For example, the first and second couplings may be first and second polarizabilities of the scattering elements at the frequency or frequency band of the guided wave or surface wave. In one approach the first coupling is a substantially nonzero coupling whereas the second coupling is a substantially zero coupling. In another approach both couplings are substantially nonzero but the first coupling is substantially greater than (or less than) than the second coupling. On account of the first and second couplings, the first and second scattering elements 102*a*, 102*b* are responsive to the guided wave or surface wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as a plane wave 110 that radiates from the surface scattering antenna 100.

The emergence of the plane wave may be understood by regarding the particular pattern of adjustment of the scattering elements (e.g. an alternating arrangement of the first and second scattering elements in FIG. 1) as a pattern that defines a grating that scatters the guided wave or surface wave 105 to produce the plane wave 110. Because this pattern is adjustable, some embodiments of the surface scattering antenna may provide adjustable gratings or, more generally, holograms, where the pattern of adjustment of the scattering elements may be selected according to principles of holography. Suppose, for example, that the guided wave or surface wave may be represented by a complex scalar input wave $\Psi_{in}$ that is a function of position along the wave-propagating structure 104, and it is desired that the surface scattering antenna produce an output wave that may be represented by another complex scalar wave $\Psi_{out}$. Then a pattern of adjustment of the scattering elements may be selected that corresponds to an interference pattern of the input and output waves along the wave-propagating structure. For example, the scattering elements may be adjusted to provide couplings to the guided wave or surface wave that are functions of (e.g. are proportional to, or step-functions of) an interference term given by $\mathrm{Re}[\Psi_{out}\Psi_{in}]$. In this way, embodiments of the surface scattering antenna may be adjusted to provide arbitrary antenna radiation patterns by identifying an output wave $\Psi_{out}$ corresponding to a selected beam pattern, and then adjusting the scattering elements accordingly as above. Embodiments of the surface scattering antenna may therefore be adjusted to provide, for example, a selected beam direction (e.g. beam steering), a selected beam width or shape (e.g. a fan or pencil beam having a broad or narrow beamwidth), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing and/or near-field nulls.

Because the spatial resolution of the interference pattern is limited by the spatial resolution of the scattering elements, the scattering elements may be arranged along the wave-propagating structure with inter-element spacings that are much less than a free-space wavelength corresponding to an operating frequency of the device (for example, less than one-third, one-fourth, or one-fifth of this free-space wavelength). In some approaches, the operating frequency is a microwave frequency, selected from frequency bands such as L, S, C, X, Ku, K, Ka, Q, U, V, E, W, F, and D, corresponding to frequencies ranging from about 1 GHz to 170 GHz and free-space wavelengths ranging from millimeters to tens of centimeters. In other approaches, the operating frequency is an RF frequency, for example in the range of about 100 MHz to 1 GHz. In yet other approaches, the operating frequency is a millimeter-wave frequency, for example in the range of about 170 GHz to 300 GHz. These ranges of length scales admit the fabrication of scattering elements using conventional printed circuit board or lithographic technologies.

Figure 2A:
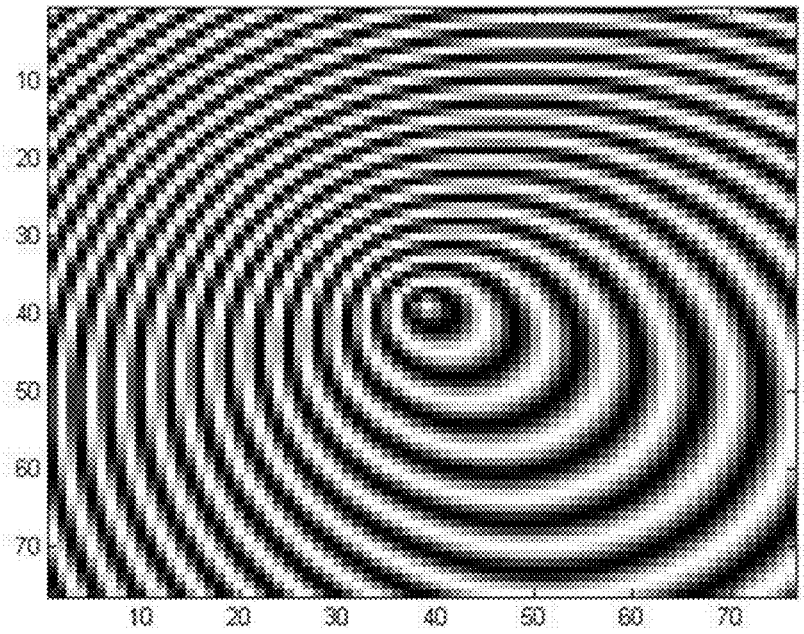
FIGS. 2A and 2B respectively depict an exemplary adjustment pattern and corresponding beam pattern for a surface scattering antenna.
Figure 2B:
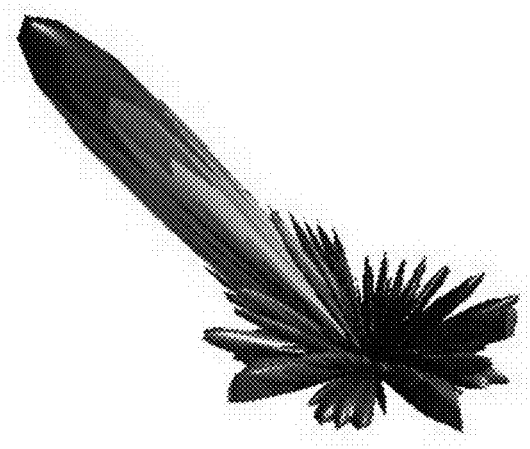
Figure 3A:
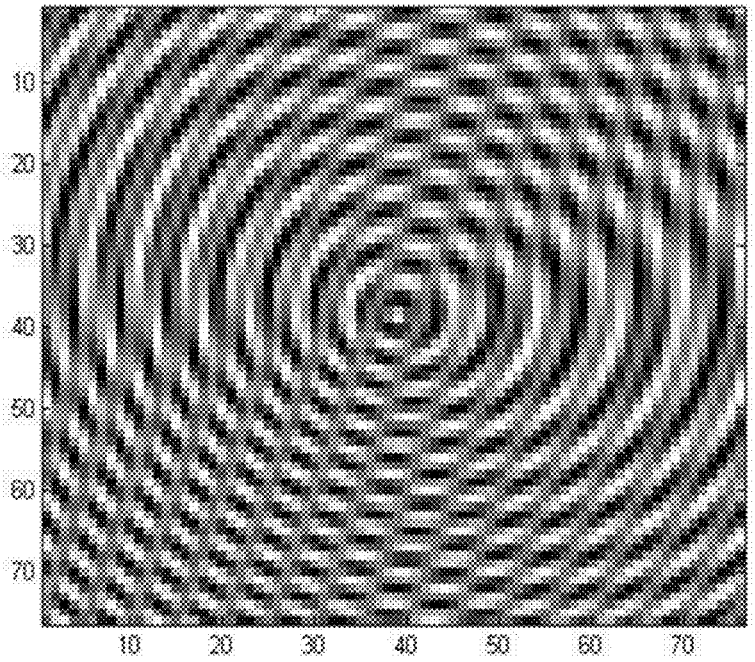
FIGS. 3A and 3B respectively depict another exemplary adjustment pattern and corresponding beam pattern for a surface scattering antenna.
Figure 3B:
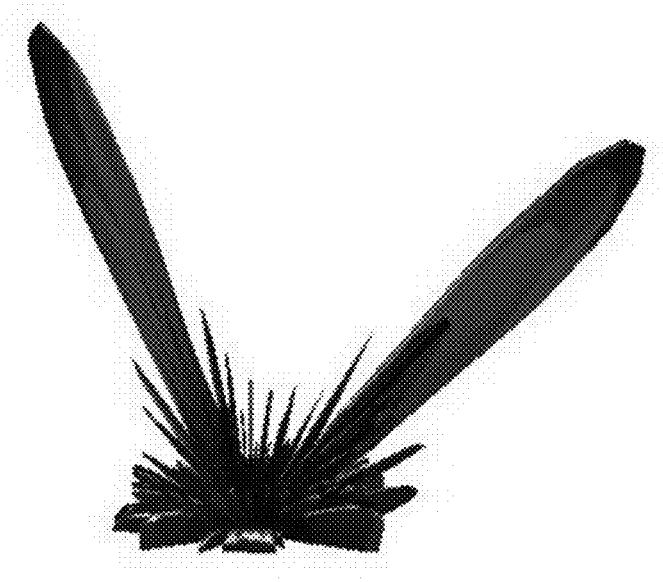

In some approaches, the surface scattering antenna includes a substantially one-dimensional wave-propagating structure 104 having a substantially one-dimensional arrangement of scattering elements, and the pattern of adjustment of this one-dimensional arrangement may provide, for example, a selected antenna radiation profile as a function of zenith angle (i.e. relative to a zenith direction that is parallel to the one-dimensional wave-propagating structure). In other approaches, the surface scattering antenna includes a substantially two-dimensional wave-propagating structure 104 having a substantially two-dimensional arrangement of scattering elements, and the pattern of adjustment of this two-dimensional arrangement may provide, for example, a selected antenna radiation profile as a function of both zenith and azimuth angles (i.e. relative to a zenith direction that is perpendicular to the two-dimensional wave-propagating structure). Exemplary adjustment patterns and beam patterns for a surface scattering antenna that includes a two-dimensional array of scattering elements distributed on a planar rectangular wave-propagating structure are depicted in FIGS. 2A-4B. In these exemplary embodiments, the planar rectangular wave-propagating structure includes a monopole antenna feed that is positioned at the geometric center of the structure. FIG. 2A presents an adjustment pattern that corresponds to a narrow beam having a selected zenith and azimuth as depicted by the beam pattern diagram of FIG. 2B. FIG. 3A presents an adjustment pattern that corresponds to a dual-beam far field pattern as depicted by the beam pattern diagram of FIG. 3B.

Figure 4A:
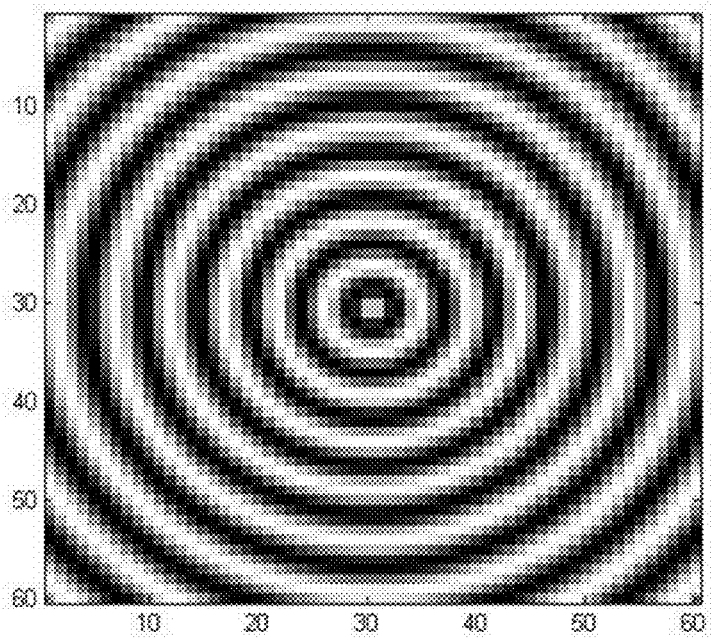
FIGS. 4A and 4B respectively depict another exemplary adjustment pattern and corresponding field pattern for a surface scattering antenna.
Figure 4B:
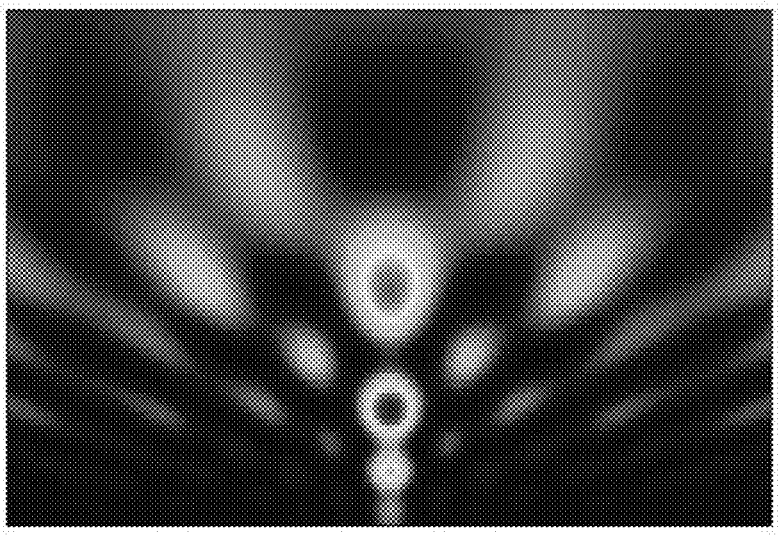

FIG. 4A presents an adjustment pattern that provides near-field focusing as depicted by the field intensity map of FIG. 4B (which depicts the field intensity along a plane perpendicular to and bisecting the long dimension of the rectangular wave-propagating structure).

In some approaches, the wave-propagating structure is a modular wave-propagating structure and a plurality of modular wave-propagating structures may be assembled to compose a modular surface scattering antenna. For example, a plurality of substantially one-dimensional wave-propagating structures may be arranged, for example, in an interdigital fashion to produce an effective two-dimensional arrangement of scattering elements. The interdigital arrangement may comprise, for example, a series of adjacent linear structures (i.e. a set of parallel straight lines) or a series of adjacent curved structures (i.e. a set of successively offset curves such as sinusoids) that substantially fills a two-dimensional surface area. These interdigital arrangements may include a feed connector having a tree structure, e.g. a binary tree providing repeated forks that distribute energy from the feed structure 108 to the plurality of linear structures (or the reverse thereof). As another example, a plurality of substantially two-dimensional wave-propagating structures (each of which may itself comprise a series of one-dimensional structures, as above) may be assembled to produce a larger aperture having a larger number of scattering elements; and/or the plurality of substantially two-dimensional wave-propagating structures may be assembled as a three-dimensional structure (e.g. forming an A-frame structure, a pyramidal structure, or other multi-faceted structure). In these modular assemblies, each of the plurality of modular wave-propagating structures may have its own feed connector(s) 106, and/or the modular wave-propagating structures may be configured to couple a guided wave or surface wave of a first modular wave-propagating structure into a guided wave or surface wave of a second modular wave-propagating structure by virtue of a connection between the two structures.

In some applications of the modular approach, the number of modules to be assembled may be selected to achieve an aperture size providing a desired telecommunications data capacity and/or quality of service, and/or a three-dimensional arrangement of the modules may be selected to reduce potential scan loss. Thus, for example, the modular assembly could comprise several modules mounted at various locations/orientations flush to the surface of a vehicle such as an aircraft, spacecraft, watercraft, ground vehicle, etc. (the modules need not be contiguous). In these and other approaches, the wave-propagating structure may have a substantially non-linear or substantially non-planar shape whereby to conform to a particular geometry, therefore providing a conformal surface scattering antenna (conforming, for example, to the curved surface of a vehicle).

More generally, a surface scattering antenna is a reconfigurable antenna that may be reconfigured by selecting a pattern of adjustment of the scattering elements so that a corresponding scattering of the guided wave or surface wave produces a desired output wave. Suppose, for example, that the surface scattering antenna includes a plurality of scattering elements distributed at positions $\{r_j\}$ along a wave-propagating structure 104 as in FIG. 1 (or along multiple wave-propagating structures, for a modular embodiment) and having a respective plurality of adjustable couplings $\{\alpha_j\}$ to the guided wave or surface wave 105. The guided wave or surface wave 105, as it propagates along or within the (one or more) wave-propagating structure(s), presents a wave amplitude $A_j$ and phase $\varphi_j$ to the jth scattering element; subsequently, an output wave is generated as a superposition of waves scattered from the plurality of scattering elements:

$$E(\theta, \phi) = \sum_j R_j(\theta, \phi)\alpha_j A_j e^{i\varphi_j} e^{i(k(\theta,\phi)\cdot r_j)}, \tag{1}$$

where $E(\theta,\phi)$ represents the electric field component of the output wave on a far-field radiation sphere, $R_j(\theta,\phi)$ represents a (normalized) electric field pattern for the scattered wave that is generated by the jth scattering element in response to an excitation caused by the coupling $\alpha_j$, and $k(\theta,\phi)$ represents a wave vector of magnitude $\omega/c$ that is perpendicular to the radiation sphere at $(\theta,\phi)$. Thus, embodiments of the surface scattering antenna may provide a reconfigurable antenna that is adjustable to produce a desired output wave $E(\theta,\phi)$ by adjusting the plurality of couplings $\{\alpha_j\}$ in accordance with equation (1).

The wave amplitude $A_j$ and phase $\varphi_j$ of the guided wave or surface wave are functions of the propagation characteristics of the wave-propagating structure 104. These propagation characteristics may include, for example, an effective refractive index and/or an effective wave impedance, and these effective electromagnetic properties may be at least partially determined by the arrangement and adjustment of the scattering elements along the wave-propagating structure. In other words, the wave-propagating structure, in combination with the adjustable scattering elements, may provide an adjustable effective medium for propagation of the guided wave or surface wave, e.g. as described in D. R. Smith et al, previously cited. Therefore, although the wave amplitude $A_j$ and phase $\varphi_j$ of the guided wave or surface wave may depend upon the adjustable scattering element couplings $\{\alpha_j\}$ (i.e. $A_i=A_i(\{\alpha_j\})$, $\varphi_i=\varphi_i(\{\alpha_j\})$), in some embodiments these dependencies may be substantially predicted according to an effective medium description of the wave-propagating structure.

In some approaches, the reconfigurable antenna is adjustable to provide a desired polarization state of the output wave $E(\theta,\phi)$. Suppose, for example, that first and second subsets $LP^{(1)}$ and $LP^{(2)}$ of the scattering elements provide (normalized) electric field patterns $R^{(1)}(\theta,\phi)$ and $R^{(2)}(\theta,\phi)$, respectively, that are substantially linearly polarized and substantially orthogonal (for example, the first and second subjects may be scattering elements that are perpendicularly oriented on a surface of the wave-propagating structure 104). Then the antenna output wave $E(\theta,\phi)$ may be expressed as a sum of two linearly polarized components:

$$E(\theta, \phi) = E^{(1)}(\theta, \phi) + E^{(2)}(\theta, \phi) = \Lambda^{(1)}R^{(1)}(\theta, \phi) + \Lambda^{(2)}R^{(2)}(\theta, \phi), \tag{2}$$

where $$\Lambda^{(1,2)}(\theta, \phi) = \sum_{j\in LP^{(1,2)}} \alpha_j A_j e^{i\varphi_j} e^{i(k(\theta,\phi)\cdot r_j)} \tag{3}$$

are the complex amplitudes of the two linearly polarized components. Accordingly, the polarization of the output wave $E(\theta,\phi)$ may be controlled by adjusting the plurality of couplings $\{\alpha_j\}$ in accordance with equations (2)-(3), e.g. to provide an output wave with any desired polarization (e.g. linear, circular, or elliptical).

Alternatively or additionally, for embodiments in which the wave-propagating structure has a plurality of feeds (e.g.

one feed for each "finger" of an interdigital arrangement of one-dimensional wave-propagating structures, as discussed above), a desired output wave $E(\theta,\phi)$ may be controlled by adjusting gains of individual amplifiers for the plurality of feeds. Adjusting a gain for a particular feed line would correspond to multiplying the $A_j$'s by a gain factor G for those elements j that are fed by the particular feed line. Especially, for approaches in which a first wave-propagating structure having a first feed (or a first set of such structures/feeds) is coupled to elements that are selected from $LP^{(1)}$ and a second wave-propagating structure having a second feed (or a second set of such structures/feeds) is coupled to elements that are selected from $LP^{(2)}$, depolarization loss (e.g., as a beam is scanned off-broadside) may be compensated by adjusting the relative gain(s) between the first feed(s) and the second feed(s).

Figure 10:
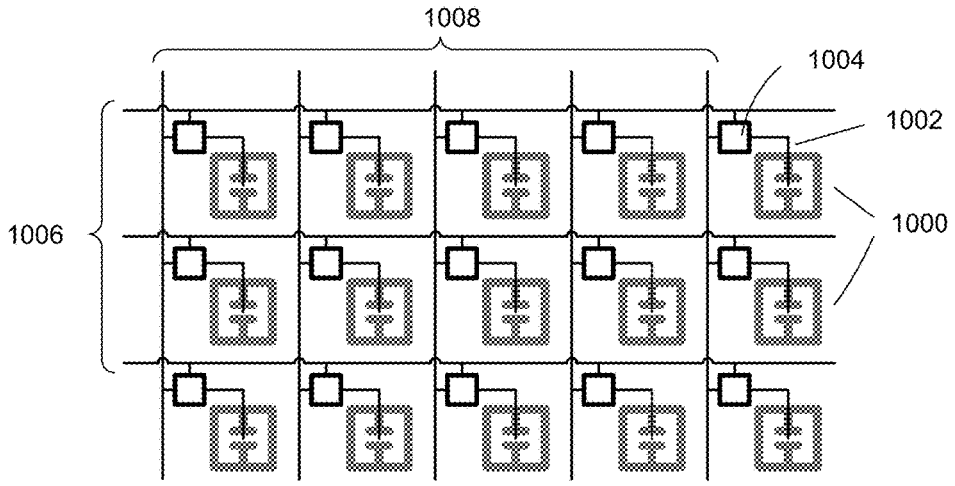
FIG. 10 depicts a surface scattering antenna with matrix addressing of the scattering elements.

As mentioned previously in the context of FIG. 1, in some approaches the surface scattering antenna 100 includes a wave-propagating structure 104 that may be implemented as a closed waveguide (or a plurality of closed waveguides); and in these approaches, the scattering elements may include complementary metamaterial elements or patch elements. Exemplary closed waveguides that include complementary metamaterial elements are depicted in FIGS. 10 and 11 of A. Bily et al, previously cited. Another exemplary closed waveguide embodiment that includes patch elements is presently depicted in FIG. 5. In this embodiment, a closed waveguide with a rectangular cross section is defined by a trough 502 and a first printed circuit board 510 having three layers: a lower conductor 512, a middle dielectric 514, and an upper conductor 516. The upper and lower conductors may be electrically connected by stitching vias (not shown). The trough 502 can be implemented as a piece of metal that is milled or cast to provide the "floor and walls" of the closed waveguide, with the first printed circuit board 510 providing the waveguide "ceiling." Alternatively, the trough 502 may be implemented with an epoxy laminate material (such as FR-4) in which the waveguide channel is routed or machined and then plated (e.g. with copper) using a process similar to a standard PCB through hole/via process. Overlaid on the first printed circuit board 510 are a dielectric spacer 520 and second printed circuit board 530. As the unit cell cutaway shows, the conducting surface 516 has an iris 518 that permits coupling between a guided wave and the resonator element 540, which in this case is a rectangular patch element disposed on the lower surface of the second printed circuit board 530. A via 536 through the dielectric layer 534 of the second printed circuit board 530 can be used to connect a bias voltage line 538 to the patch element 540. The patch element 540 may be optionally bounded by collonades of vias 550 extended through the dielectric layer 534 to reduce coupling or crosstalk between adjacent unit cells. The dielectric spacer 520 includes a cutout region 525 between the iris 518 and the patch 540, and this cutout region is filled with an electrically tunable medium (such as a liquid crystal medium) to accomplish tuning of the cell resonance.

Figure 5:
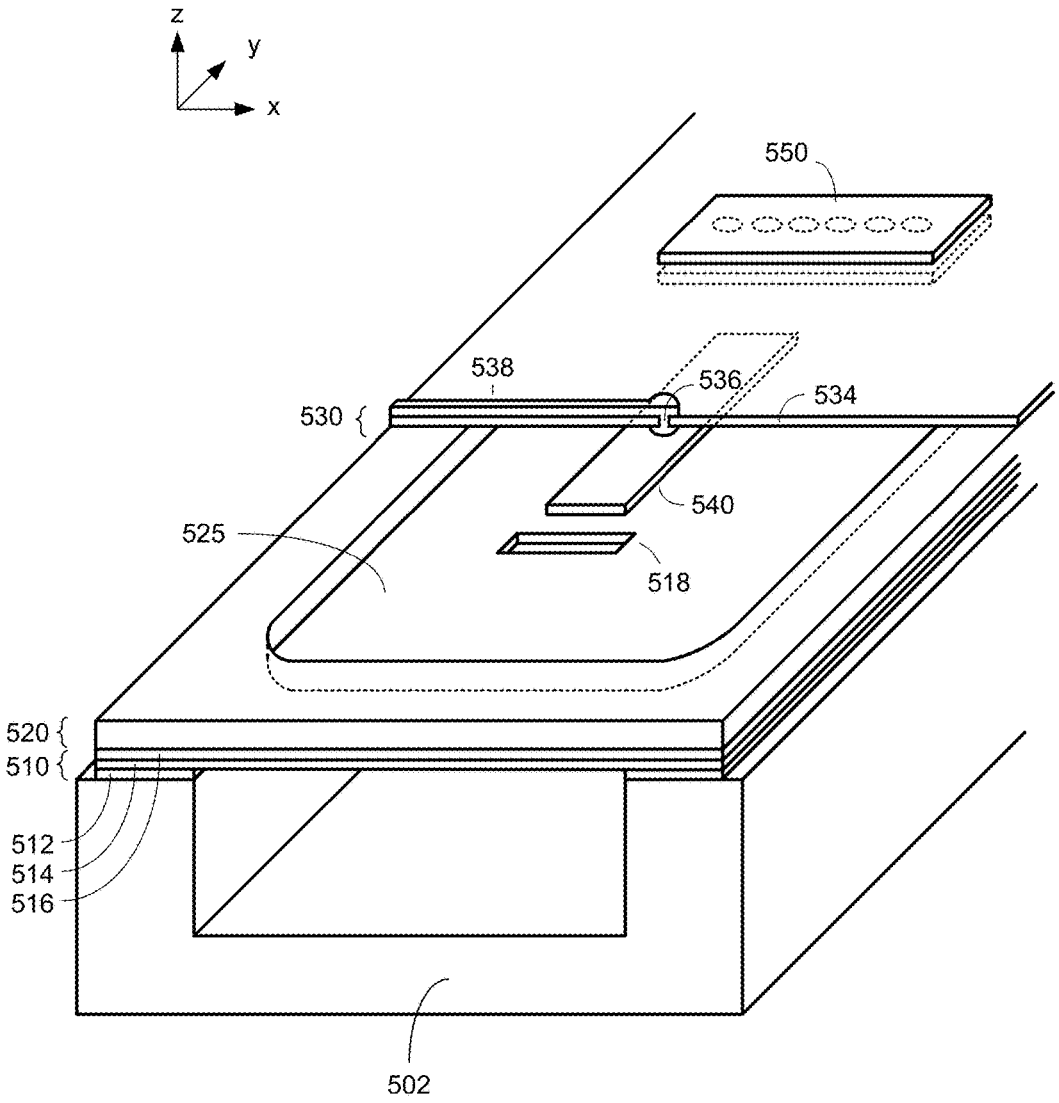
FIG. 5 depicts an embodiment of a surface scattering antenna including a patch element.

While the waveguide embodiment of FIG. 5 provides a waveguide having a simple rectangular cross section, in some approaches the waveguide may include one or more ridges (as in a double-ridged waveguide). Ridged waveguides can provide greater bandwidth than simple rectangular waveguides and the ridge geometries (widths/heights) can be varied along the length of the waveguide to control the couplings to the scattering elements (e.g. to enhance aperture efficiency and/or control aperture tapering of the beam profile) and/or to provide a smooth impedance transition (e.g. from an SMA connector feed). Alternatively or additionally, the waveguide may be loaded with a dielectric material (such as PTFE). This dielectric material can occupy all or a portion of the waveguide cross section, and the amount of the cross section that is occupied can also be tapered along the length of the waveguide.

Figure 6A:
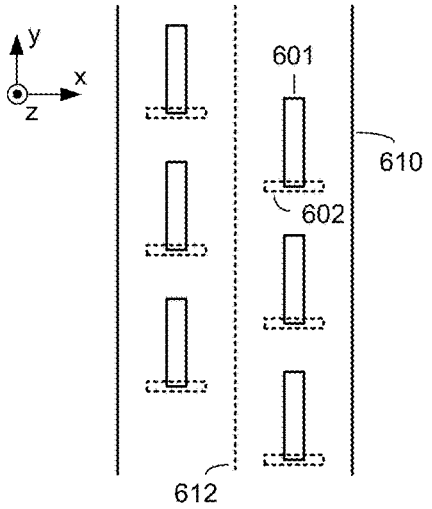
FIGS. 6A and 6B depict examples of patch elements on a waveguide.
Figure 6B:
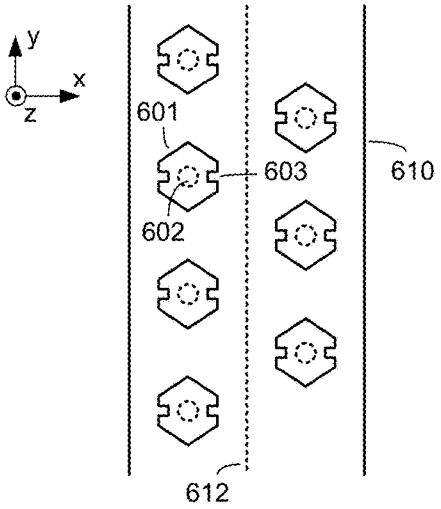

While the example of FIG. 5 depicts a rectangular patch 540 fed by a narrow iris 518, a variety of patch and iris geometries may be used, with exemplary configurations depicted in FIG. 6A-6B. These figures depict the placement of patches 601 and irises 602 when viewed looking down upon a closed waveguide 610 having a center axis 612. FIG. 6A shows rectangular patches 601 oriented along the y-direction and edge-fed by slit-like irises 602 oriented along the x-direction. FIG. 6B shows hexagonal patches 601 center-fed by circular irises 602. The hexagonal patches may include notches 603 to adjust the resonant frequencies of the patches. It will be appreciated that the irises and patches can take a variety of other shapes including rectangles, squares, ellipses, circles, or polygons, with or without notches or tabs to adjust resonant frequencies, and that the relative lateral (x and/or y) position between patch and iris may be adjusted to achieve a desired patch response, e.g. edge-fed or center-fed. For example, an offset feed may be used to stimulate circularly polarization radiation. The positions, shapes, and/or sizes of the irises and/or patches can be gradually adjusted or tapered along the length of the waveguide, to control the waveguide couplings to the patch elements (e.g. to enhance overall aperture efficiency and/or control aperture tapering of the beam profile).

Figure 6C:
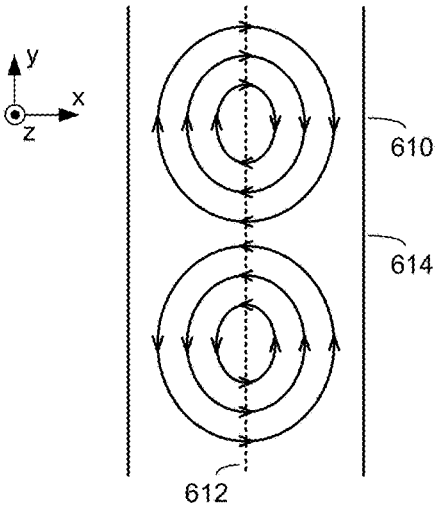
FIG. 6C depicts field lines for a waveguide mode.

Because the irises 602 couple the patches 601 to the guided wave mode by means of the H-field that is present at the upper surface of the waveguide, the irises can be particularly positioned along the y-direction (perpendicular to the waveguide) to exploit the pattern of this H-field at the upper surface of the waveguide. FIG. 6C depicts this H-field pattern for the dominant TE10 mode of a rectangular waveguide. On the center axis 612 of the waveguide, the H-field is entirely directed along the x-direction, whereas at the edge 614 of the waveguide, the H-field is entirely directed along the y-direction. For a slit-like iris oriented along the x-direction, the iris-mediated coupling between the patch and the waveguide can be adjusted by changing the x-position of the iris; thus, for example, slit-like irises can be positioned equidistant from the center axis 612 on left and right sides of the waveguide for equal coupling, as in FIG. 6A. This x-positioning of the irises can also be gradually adjusted or tapered along the length of the waveguide, to control the couplings to the patch elements (e.g. to enhance overall aperture efficiency and/or control aperture tapering of the beam profile).

For positions intermediate between the center axis 612 and the edge 614 in FIG. 6C, the H-field has both x and y components and sweeps out an ellipse at a fixed iris location as the guided wave mode propagates along the waveguide. Thus, the iris-mediated coupling between the patch and the waveguide can be adjusted by changing the x-position of the iris: changing the distance from the center axis 612 adjusts the eccentricity of the coupled H-field, which switching from one side of the center axis to the other side reverses the direction of rotation of the coupled H-field.

In one approach, the rotation of the H-field for a fixed position away from the center axis 612 of the waveguide can be exploited to provide a beam that is circularly polarized by virtue of this H-field rotation. A patch with two resonant modes having mutually orthogonal polarization states can leverage the rotation of the H-field excitation to result in a circular or elliptical polarization. For example, for a guided wave TE10 mode that propagates in the +y direction of FIG. 6C, positioning an iris and center-fed square or circular patch halfway between the center axis and the left edge of the waveguide will yield a right-circular-polarized radiation pattern for the patch, while positioning the iris and center-fed square or circular patch halfway between the center axis and the right edge of the waveguide will yield a left-circular-polarized radiation pattern for the patch. Thus, the antenna may be switched between polarization states by switching from active elements on the left half of the waveguide to active elements on the right half of the waveguide or vice versa, or by reversing the direction of propagation of the guided wave TE10 mode (e.g. by feeding the waveguide from the opposite end).

Alternatively, for scattering elements that yield linear polarization patterns, as for the configuration of FIG. 6A, the linear polarization may be converted to circular polarization by placing a linear-to-circular polarization conversion structure above the scattering elements. For example, a quarter-wave plate or meander-line structure may be positioned above the scattering elements. Quarter-wave plates may include anisotropic dielectric materials (see, e.g., H. S. Kirschbaum and S. Chen, "A Method of Producing Broad-Band Circular Polarization Employing an Anisotropic Dielectric," IRE Trans. Micro. Theory. Tech., Vol. 5, No. 3, pp. 199-203, 1957; J. Y. Chin et al, "An efficient broadband metamaterial wave retarder," Optics Express, Vol. 17, No. 9, pp. 7640-7647, 2009), and/or may also be implemented as artificial magnetic materials (see, e.g., Dunbao Yan et al, "A Novel Polarization Convert Surface Based on Artificial Magnetic Conductor," Asia-Pacific Microwave Conference Proceedings, 2005). Meander-line polarizers typically consist of two, three, four, or more layers of conducting meander line arrays (e.g. copper on a thin dielectric substrate such as Duroid), with interleaved spacer layers (e.g. closed-cell foam). Meander-line polarizers may be designed and implemented according to known techniques, for example as described in Young, et. al., "Meander-Line Polarizer," IEEE Trans. Ant. Prop., pp. 376-378, May 1973 and in R. S. Chu and K. M. Lee, "Analytical Model of a Multilayered Meander-Line Polarizer Plate with Normal and Oblique Plane-Wave Incidence," IEEE Trans. Ant. Prop., Vol. AP-35, No. 6, pp. 652-661, June 1987. In embodiments that include a linear-to-circular polarization conversion structure, the conversion structure may be incorporated into, or may function as, a radome providing environmental insulation for the antenna. Moreover, the conversion structure may be flipped over to reverse the polarization state of the transmitted or received radiation.

The electrically tunable medium that occupies the cutaway region 125 between the iris 118 and patch 140 in FIG. 6 may include a liquid crystal. Liquid crystals have a permittivity that is a function of orientation of the molecules comprising the liquid crystal; and that orientation may be controlled by applying a bias voltage (equivalently, a bias electric field) across the liquid crystal; accordingly, liquid crystals can provide a voltage-tunable permittivity for adjustment of the electromagnetic properties of the scattering element. Exemplary liquid crystals that may be deployed in various embodiments include 4-Cyano-4'-pentylbiphenyl and high birefringence eutectic LC mixtures such as LCMS-107 (LC Matter) or GT3-23001 (Merck).

Some approaches may utilize dual-frequency liquid crystals. In dual-frequency liquid crystals, the liquid crystal director aligns substantially parallel to an applied bias field at a lower frequencies, but substantially perpendicular to an applied bias field at higher frequencies. Accordingly, for approaches that deploy these dual-frequency liquid crystals, tuning of the scattering elements may be accomplished by adjusting the frequency of the applied bias voltage signals.

Other approaches may deploy polymer network liquid crystals (PNLCs) or polymer dispersed liquid crystals (PDLCs), which generally provide much shorter relaxation/switching times for the liquid crystal. An example is a thermal or UV cured mixture of a polymer (such as BPA-dimethacrylate) in a nematic LC host (such as LCMS-107); cf. Y. H. Fan et al, "Fast-response and scattering-free polymer network liquid crystals for infrared light modulators," *Applied Physics Letters* 84, 1233-35 (2004), herein incorporated by reference. Whether the polymer-liquid crystal mixture is described as a PNLC or a PDLC depends upon the relative concentration of polymer and liquid crystal, the latter having a higher concentration of polymer whereby the LC is confined in the polymer network as droplets.

Some approaches may include a liquid crystal that is embedded within an interstitial medium. An example is a porous polymer material (such as a PTFE membrane) impregnated with a nematic LC (such as LCMS-107); cf. T. Kuki et al, "Microwave variable delay line using a membrane impregnated with liquid crystal," *Microwave Symposium Digest,* 2002 *IEEE MTT-S International*, vol. 1, pp. 363-366 (2002), herein incorporated by reference.

The interstitial medium is preferably a porous material that provides a large surface area for strong surface alignment of the unbiased liquid crystal. Examples of such porous materials include ultra high molecular weight polyethylene (UHMW-PE) and expanded polytetraflouroethylene (ePTFE) membranes that have been treated to be hydrophilic. Specific examples of such interstitial media include Advantec MFS Inc., Part # H020A047A (hydrophilic ePTFE) and DeWal Industries 402P (UHMW-PE).

Figure 7:
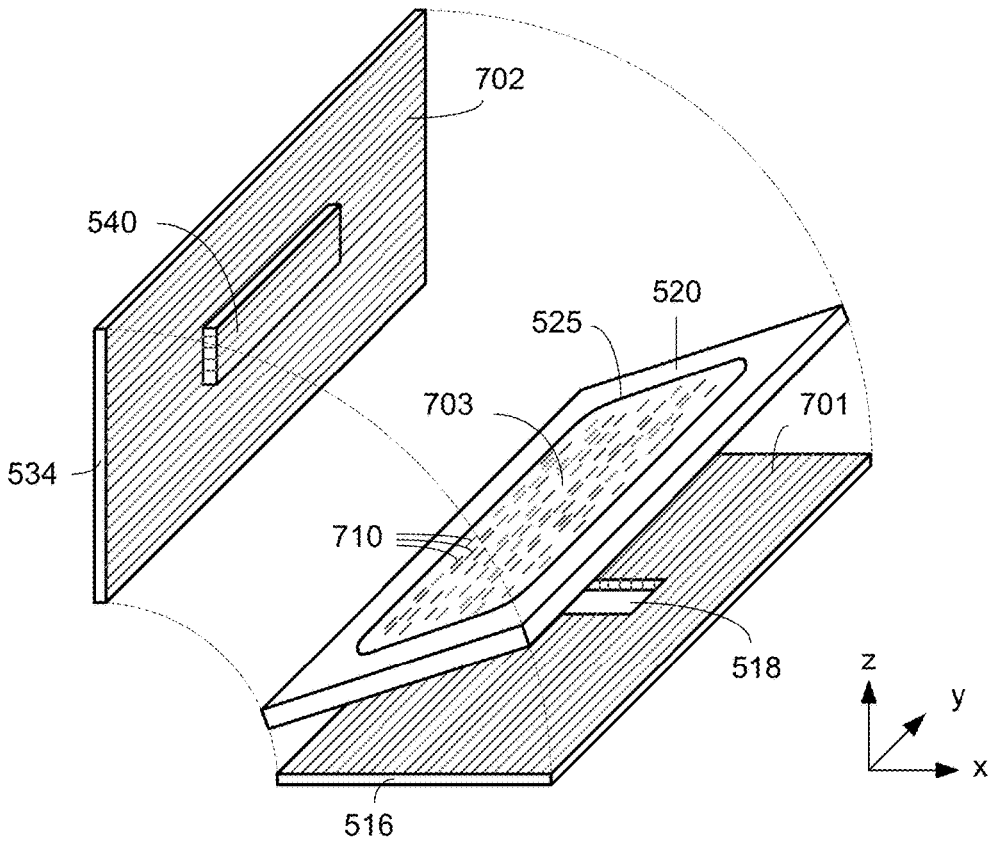
FIG. 7 depicts a liquid crystal arrangement.

In the patch arrangement of FIG. 5, it may be seen that the voltage biasing of the patch antenna relative to the conductive surface 516 containing the iris 518 will induce a substantially vertical (z-direction) alignment of the liquid crystal that occupies the cutaway region 525. Accordingly, to enhance the tuning effect, it may be desirable to arrange the interstitial medium and/or alignment layers to provide an unbiased liquid crystal alignment that is substantially horizontal (e.g. in the y direction). An example of such an arrangement is depicted in FIG. 7, which shows an exploded diagram of the same elements as in FIG. 5. In this example, the upper conductor 516 of the lower circuit board presents a lower alignment layer 701 that is aligned along the y-direction. This alignment layer may be implemented by, for example, coating the lower circuit board with a polyimide layer and rubbing or otherwise patterning (e.g. by machining or photolithography) the polyimide layer to introduce microscopic grooves that run parallel to the y-direction. Similarly, the upper dielectric 534 and patch 540 present an upper alignment layer 702 that is also aligned along the y-direction. A liquid-crystal-impregnated interstitial medium 703 fills the cutaway region 525 of the spacer layer 520; as depicted schematically in the figure, the interstitial medium may be designed and arranged to include microscopic pores 710 that extend along the y-direction to present a large surface area for the liquid crystal that is substantially along the y-direction.

In some approaches, it may be desirable to introduce one or more counter-electrodes into the unit cell, so that the unit cell can provide both a first biasing that aligns the liquid crystal substantially parallel to the electric field lines of the unit cell resonance mode, and a second biasing ("counter-biasing") that aligns the liquid crystal substantially perpendicular to the electric field lines of the unit cell resonance mode. One advantage of introducing counter-biasing is that that the unit cell tuning speed is then no longer limited by a passive relaxation time of the liquid crystal.

For purposes of characterizing counter-electrode arrangements, it is useful to distinguish between in-plane switching schemes, where the resonators are defined by conducting islands coplanar with a ground plane (e.g. as with the so-called "CELL" resonators, such as those described in A. Bily et al, previously cited), and vertical switching schemes, where the resonators are defined by patches positioned vertically above a ground plane containing irises (e.g. as in FIG. 5).

Figure 8A:
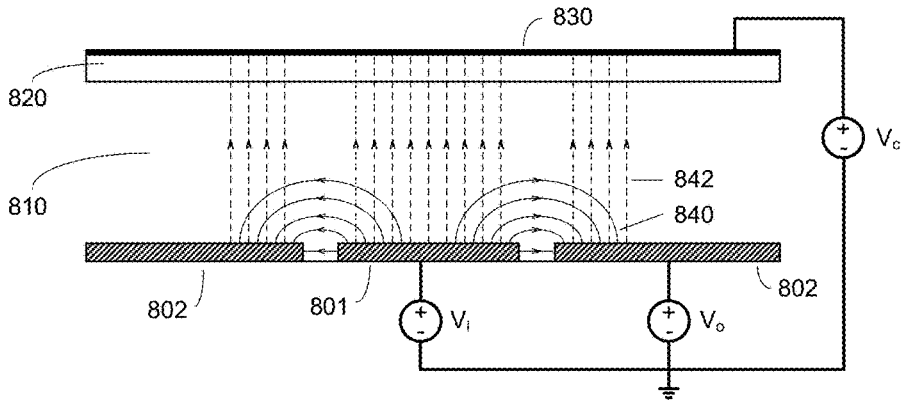
FIGS. 8A and 8B depict exemplary counter-electrode arrangements.

A counter-electrode arrangement for an in-plane switching scheme is depicted in FIG. 8A, which shows a unit cell resonator defined by an inner electrode or conducting island 801 and an outer electrode or ground plane 802. The liquid crystal material 810 is enclosed above the resonator by an enclosing structure 820, e.g. a polycarbonate container. In the exemplary counter-electrode arrangement of FIG. 8A, the counter-electrode is provided as a very thin layer 830 of a conducting material such as chromium or titanium, deposited on the upper surface of the enclosing structure 820. The layer is thin enough (e.g. 10-30 nm) to introduce only small loss at antenna operating frequencies, but sufficiently conductive that the (1/RC) charging rate is small compared to the unit cell update rate. In other approaches, the conducting layer is an organic conductor such as polyacetylene, which can be spin-coated on the enclosing structure 820. In yet other approaches, the conducting layer is an anisotropic conducting layer, i.e. having two conductivities $\sigma_1$ and $\sigma_2$ for two orthogonal directions along the layer, and the anisotropic conducting layer may be aligned relative to the unit cell resonator so that the effective conductivity seen by the unit cell resonator is minimized. For example, the anisotropic conducting layer may consist of wires or stripes that are aligned substantially perpendicular to the electric field lines of the unit cell resonance mode.

By applying a first bias corresponding to a voltage differential $V_i-V_o$ between the inner electrode 801 and outer electrode 802, a first (substantially horizontal) bias electric field 840 is established, substantially parallel to electric field lines of the unit cell resonance mode. On the other hand, by applying a second bias corresponding to a voltage differential $V_c-V_i=V_c-V_o$ between the counter-electrode 830 and the inner and outer electrodes 801 and 802, a second (substantially vertical) bias electric field 842 is established, substantially perpendicular to electric field lines of the unit cell resonance mode.

In some approaches, the second bias may be applied for a duration shorter than a relaxation time of the liquid crystal; for example, the second bias may be applied for less than one-half or one-third of this relaxation time. One advantage of this approach is that while the application of the second bias seeds the relaxation of the liquid crystal, it may be preferable to have the liquid crystal then relax to an unbiased state rather than align according to the bias electric field.

Figure 8B:
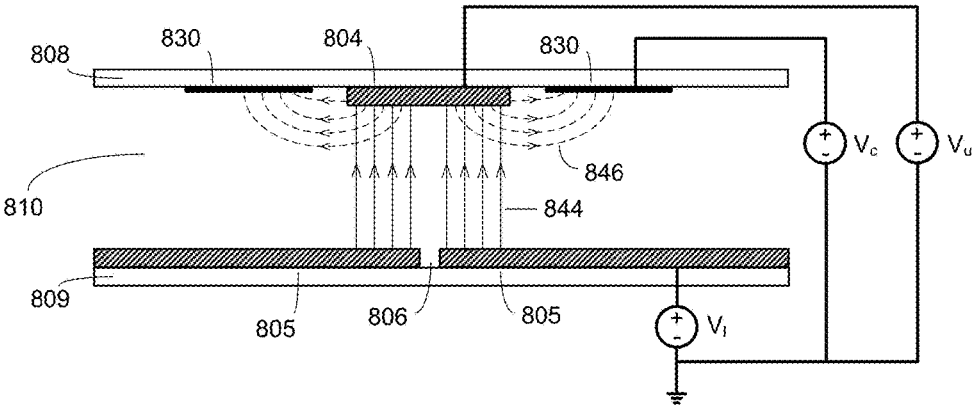

A counter-electrode arrangement for a vertical switching scheme is depicted in FIG. 8B, which shows a unit cell resonator defined by an upper patch 804 and a lower ground plane 805 containing an iris 806. The liquid crystal material 810 is enclosed within the region between the upper dielectric layer 808 (supporting the upper patch 804) and the lower dielectric layer 809 (supporting the lower ground plane 805). In the exemplary counter-electrode arrangement of FIG. 8B, the counter-electrode is provided as a very thin layer 830 of a conducting material such as chromium or titanium, deposited on the lower surface of the upper dielectric layer 808. The layer is thin enough (e.g. 10-30 nm) to introduce only small loss at antenna operating frequencies, but sufficiently conductive that the (1/RC) charging rate is small compared to the unit cell update rate. Other approaches may use organic conductors or anisotropic conducting layers, as described above.

By applying a first bias corresponding to a voltage differential $V_u-V_l=V_c-V_l$ between the upper and counter electrodes 804 and 830 and lower electrode 805, a first (substantially vertical) bias electric field 844 is established, substantially parallel to electric field lines of the unit cell resonance mode. On the other hand, by applying a second bias corresponding to a voltage differential $V_c-V_u$ between the counter electrode 830 and the upper electrode 804, a second (substantially horizontal) bias electric field 846 is established, substantially perpendicular to electric field lines of the unit cell resonance mode. Again, in some approaches, the second bias may be applied for a duration shorter than a relaxation time of the liquid crystal, for the same reason as discussed above for horizontal switching. In various embodiments of the vertical switching scheme, the counter-electrode 830 may constitute a pair of electrodes on opposite sides of the patch 804, or a U-shaped electrode that surrounds three sides of the patch 804, or a closed loop that surrounds all four sides of the patch 804.

Figure 9:
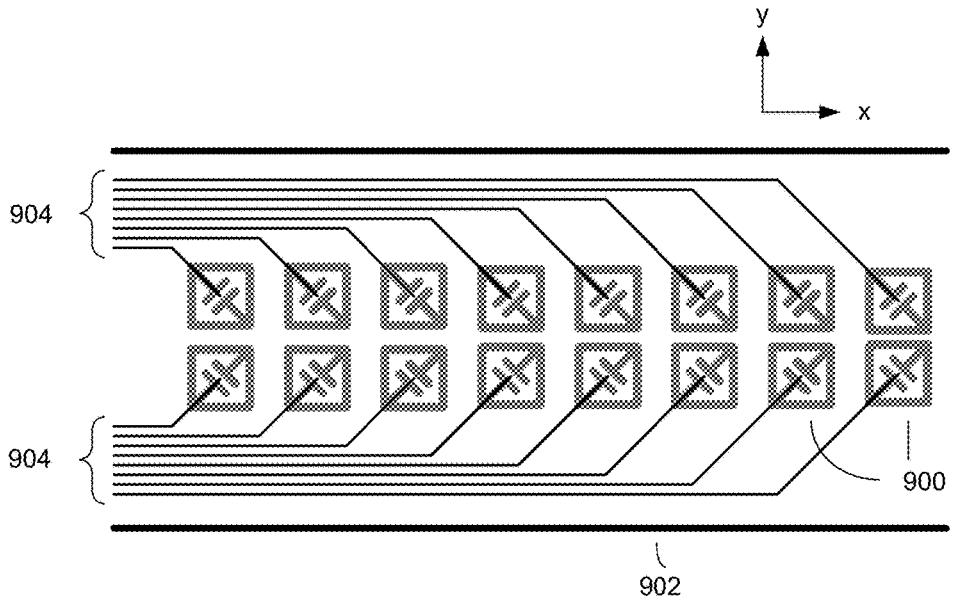
FIG. 9 depicts a surface scattering antenna with direct addressing of the scattering elements.

In various approaches, the bias voltage lines may be directly addressed, e.g. by extending a bias voltage line for each scattering element to a pad structure for connection to antenna control circuitry, or matrix addressed, e.g. by providing each scattering element with a voltage bias circuit that is addressable by row and column. FIG. 9 depicts an example of a configuration that provides direct addressing for an arrangement of scattering elements 900, in which a plurality of bias voltage lines 904 deliver individual bias voltages to the scattering elements. FIG. 10 depicts an example of a configuration that provides matrix addressing for an arrangement of scattering elements 1000, where each scattering element is connected by a bias voltage line 1002 to a biasing circuit 1004 addressable by row inputs 1006 and column inputs 1008 (note that each row input and/or column input may include one or more signals, e.g. each row or column may be addressed by a single wire or a set of parallel wires dedicated to that row or column). Each biasing circuit may contain, for example, a switching device (e.g. a transistor), a storage device (e.g. a capacitor), and/or additional circuitry such as logic/multiplexing circuitry, digital-to-analog conversion circuitry, etc. This circuitry may be readily fabricated using monolithic integration, e.g. using a thin-film transistor (TFT) process, or as a hybrid assembly of integrated circuits that are mounted on the wave-propagating structure, e.g. using surface mount technology (SMT). Although FIGS. 9 and 10 depict the scattering elements as "CELC" resonators, this depiction is intended to represent generic scattering elements, and the direct or matrix addressing schemes of FIGS. 9 and 10 are applicable to other unit cell designs (such as the patch element).

For approaches that use liquid crystal as a tunable medium for the unit cell, it may be desirable to provide unit cell bias voltages that are AC signals with a minimal DC component. Prolonged DC operation can cause electrochemical reactions that significantly reduce the usable lifespan of the liquid crystal as a tunable medium. In some approaches, a unit cell may be tuned by adjusting the amplitude of an AC bias signal. In other approaches, a unit cell may be tuned by adjusting the pulse width of an AC bias signal, e.g. using pulse width modulation (PWM). In yet other approaches, a unit cell may be tuned by adjusting both the amplitude and pulse with of an AC bias signal. Various liquid crystal drive schemes have been extensively explored in the liquid crystal display literature, for example as described in Robert Chen, *Liquid Crystal Displays*, Wiley, New Jersey, 2011, and in Willem den Boer, *Active Matrix Liquid Crystal Displays*, Elsevier, Burlington, Mass. 2009.

Figure 11A:
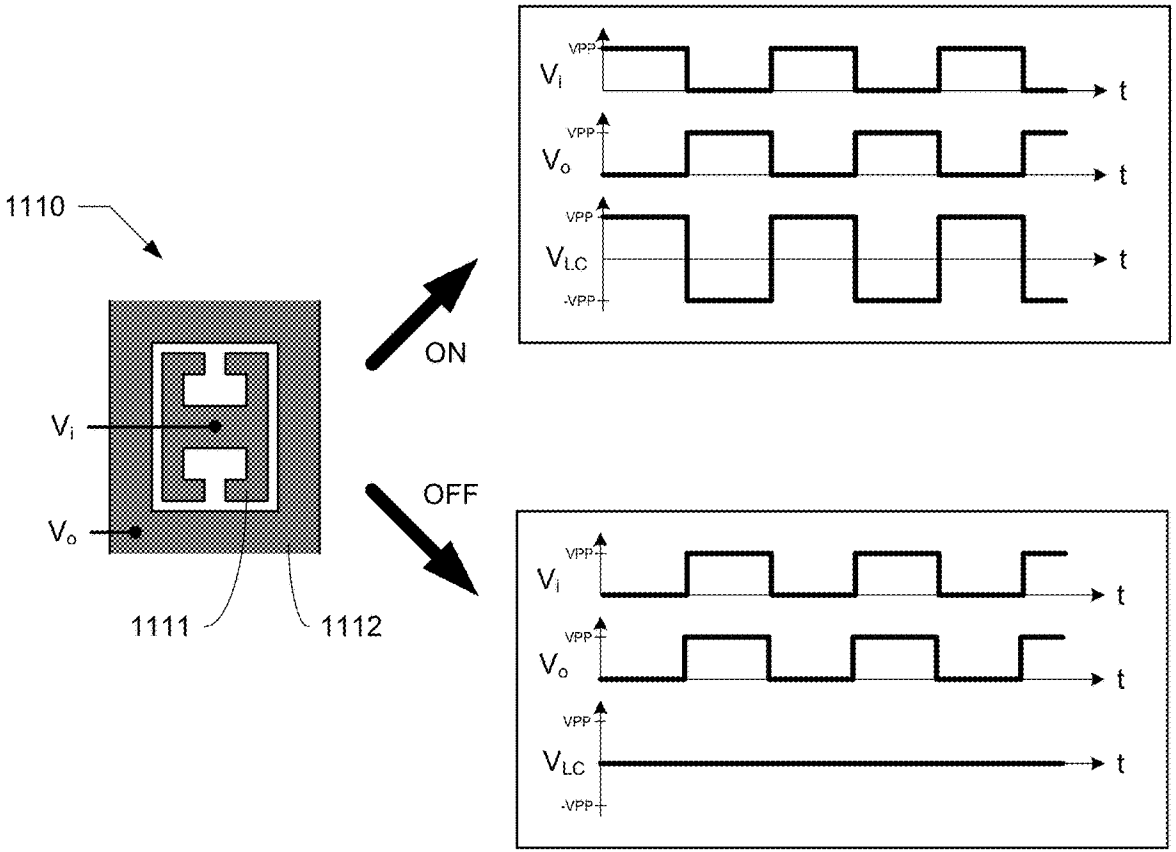
FIGS. 11A, 12A, and 13 depict various bias voltage drive schemes.

Exemplary waveforms for a binary (ON-OFF) bias voltage adjustment scheme are depicted in FIG. 11A. In this binary scheme, a first square wave voltage $V_i$ is applied to inner electrode 1111 of a unit cell 1110, and a second square wave voltage $V_o$ is applied to outer electrode 1112 of the unit cell. Although the figure depicts a "CELL" resonator defined by a conducting island (inner electrode) coplanar with a ground plane (outer electrode), this depiction is intended to represent a generic unit cell, and the drive scheme is applicable to other unit cell designs. For example, for a "patch" resonator defined by a conducting patch positioned vertically above an iris in a ground plane, the first square wave voltage $V_i$ may be applied to the patch, while the second square wave voltage $V_o$ may be applied to the ground plane.

In the binary scheme of FIG. 11A, the unit cell is biased "ON" when the two square waves are 180° out of phase with each other, with the result that the potential applied to the liquid crystal, $V_{LC}=V_i-V_o$, is a square wave with zero DC offset, as shown in the top right panel of the figure. On the other hand, the unit cell is biased "OFF" when the two square waves are in phase with each other, with the result that $V_{LC}=0$, as shown in the bottom right panel of the figure. The square wave amplitude VPP is a voltage large enough to effect rapid alignment of the liquid crystal, typically in the range of 10-100 volts. The square wave frequency is a "drive" frequency that is large compared to both the desired antenna switching rate and liquid crystal relaxation rates. The drive frequency can range from as low as 10 Hz to as high as 100 kHz.

Figure 11B:
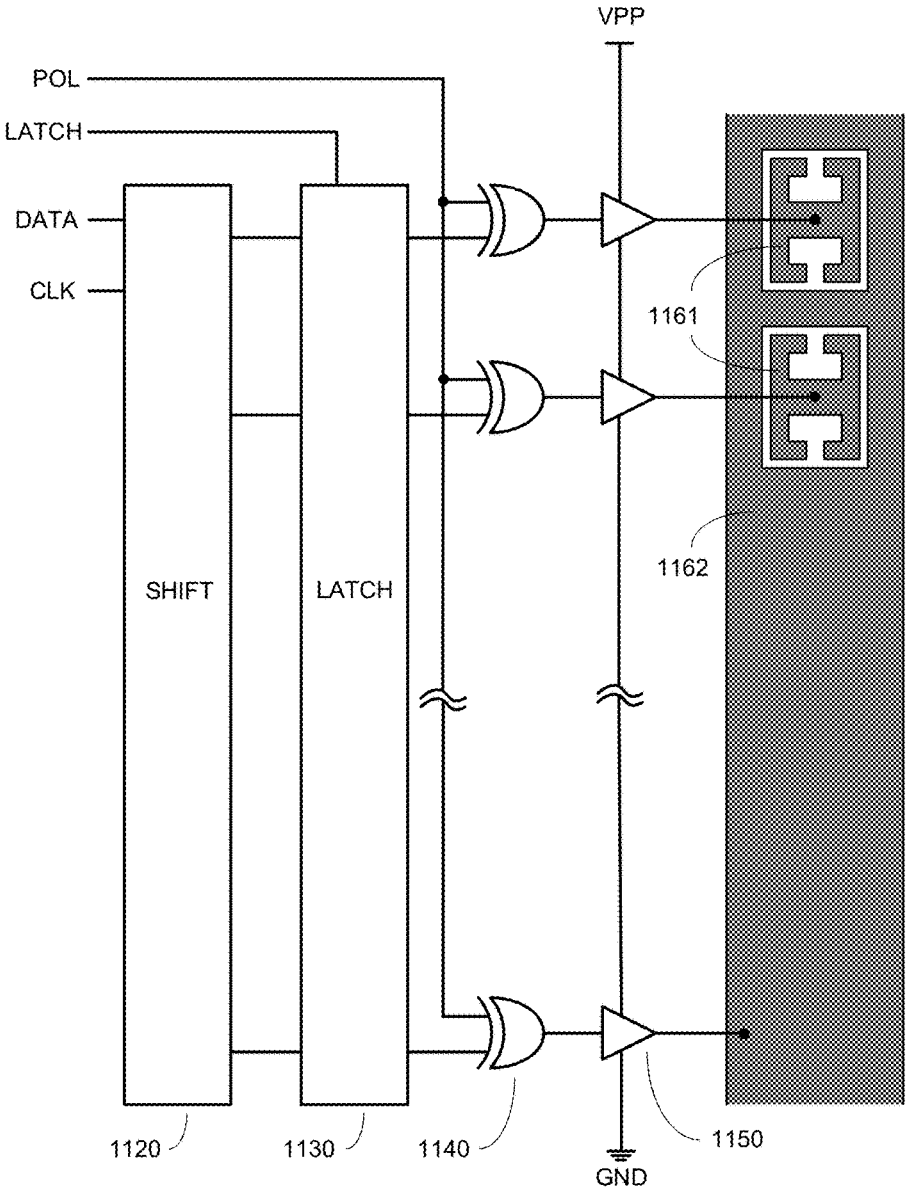
FIGS. 11B and 12B depict bias voltage drive circuitry.

Exemplary circuitry providing the waveforms of FIG. 11A to a plurality of unit cells is depicted in FIG. 11B. In this example, bits representing the "ON" or "OFF" states of the unit cells are read into a N-bit serial-to-parallel shift register 1120 using the DATA and CLK signals. When this serial read-in is complete, the LATCH signal is triggered to store these bits in an N-bit latch 1130. The N-bit latch outputs, which may be toggled with XOR gates 1140 via the POL signal, provide the inputs for high-voltage push-pull amplifiers 1150 that deliver the waveforms to the unit cells. Note that one or more bits of the shift register may be reserved to provide the waveform for the common outer electrode 1162, while the remaining bits of the shift register provide the individual waveforms for the inner electrodes 1161 of the unit cells. Alternatively, the entire shift register may be used for inner electrodes 1161, and a separate push-pull amplifier may be used for the outer electrode 1162. Square waves may be produced at the outputs of the push-pull amplifiers 1150 by either (1) toggling the XOR gates at the drive frequency (i.e. with a POL signal that is a square wave at the drive frequency) or (2) latching at twice the drive frequency (i.e. with a LATCH signal that is a square wave at twice the drive frequency) while reading in complementary bits during the second half-cycle of each drive period. Under the latter approach, because there is an N-bit read-in during each half-cycle of the drive period, the serial input data is clocked at a frequency not less than 2×N×f, where f is the drive frequency. The N-bit shift register may address all of the unit cells that compose the antenna, or several N-bit shift registers may be used, each addressing a subset of the unit cells.

The binary scheme of FIG. 11A applies voltage waveforms to both the inner and outer electrode of the unit cell. In another approach, shown in FIG. 12A, the outer electrode is grounded and a voltage waveform is applied only to the inner electrode of the unit cell. In this single-ended drive approach, the unit cell is biased "ON" when a square wave with zero DC offset is applied to the inner electrode 1111 (as shown in the top right panel of FIG. 12A) and biased "OFF" when a zero voltage is applied to the inner electrode (as shown in the bottom right panel of FIG. 12A).

Figure 12A:
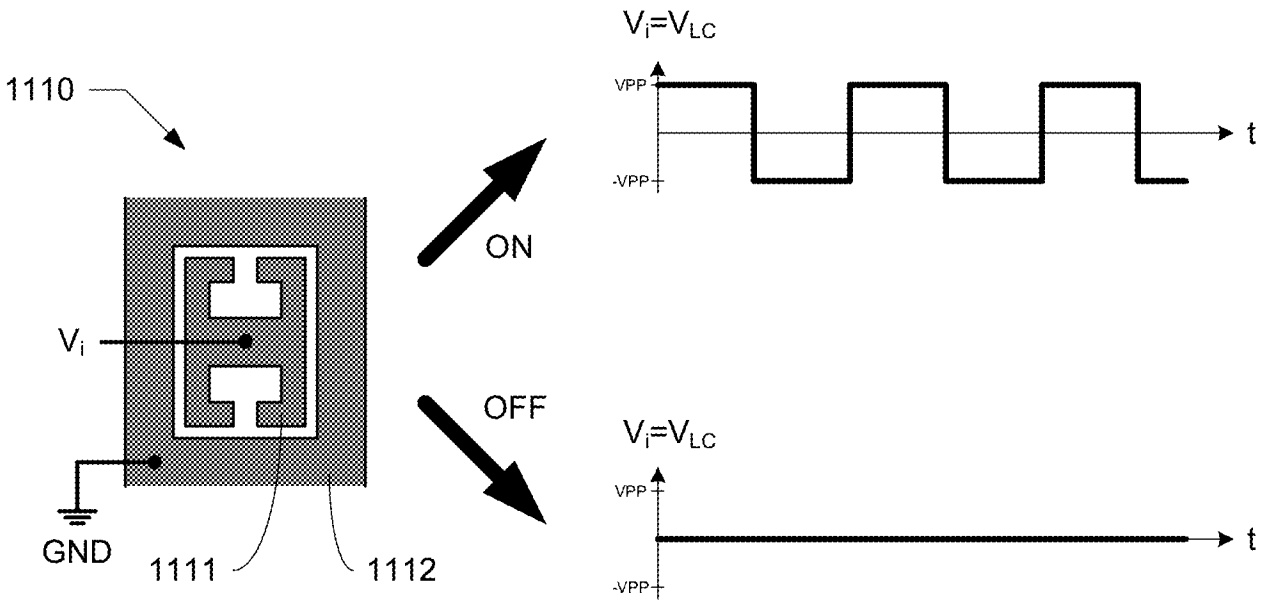
Figure 12B:
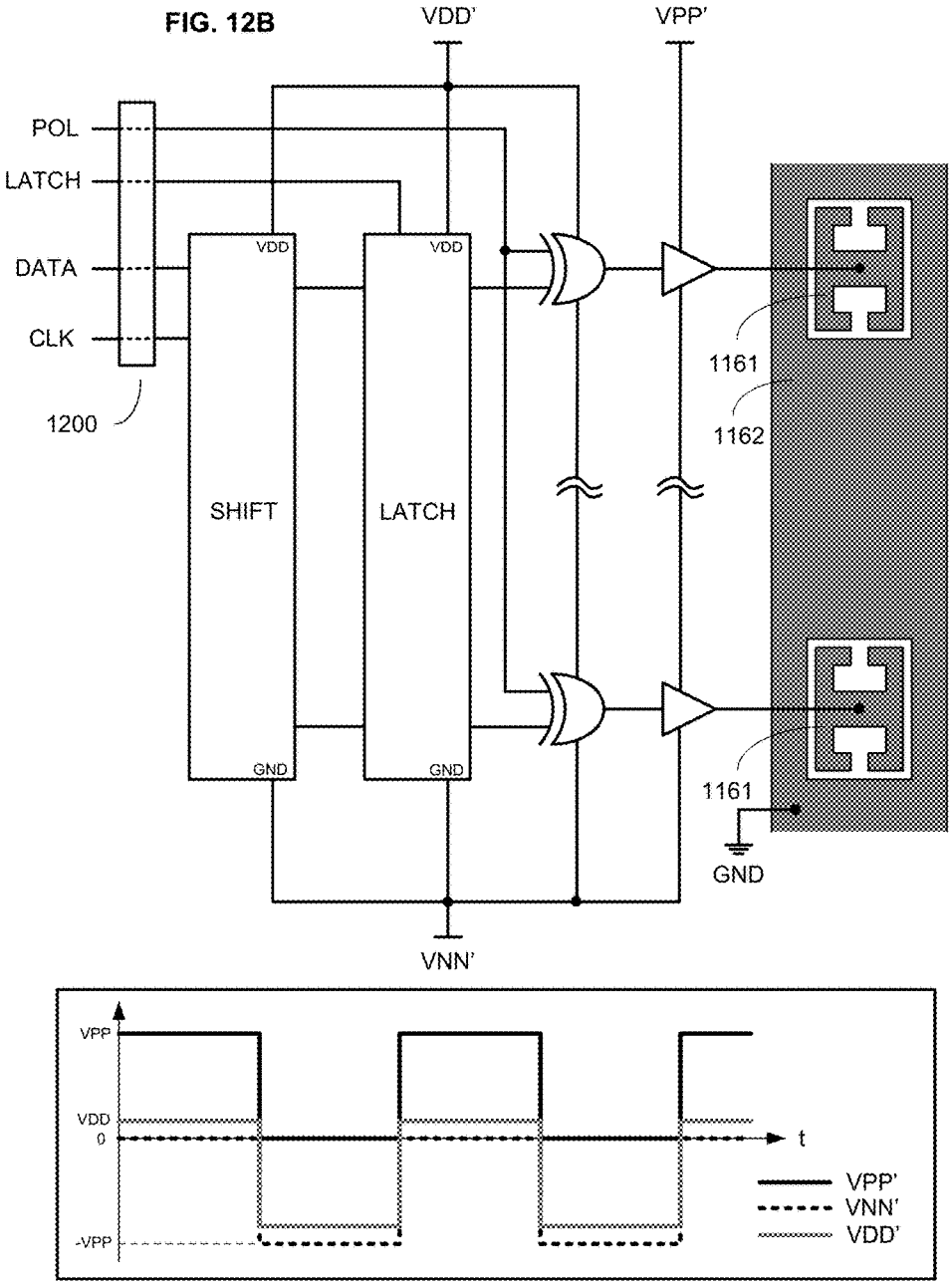

Exemplary circuitry providing the waveforms of FIG. 12A to a plurality of unit cells is depicted in FIG. 12B. The circuitry is similar to that of FIG. 11B, except that the common outer electrode is now grounded, and new oscillating power supply voltages VPP' and VDD' are used for the high-voltage circuits and the digital circuits, respectively, with the ground terminals of these circuits being connected to a new negative oscillating power supply voltage VNN'. Exemplary waveforms for these oscillating power supply voltages are shown in the lower panel of the figure. Note that these oscillating power supply voltages preserve the voltage differentials VPP'−VNN'=VPP and VDD'−VNN'=VDD, where VPP is the desired amplitude of the voltage $V_{LC}$ applied to the liquid crystal, and VDD is the power supply voltage for the digital circuitry. For the digital inputs to operate properly with these oscillating power supplies, the single-ended drive circuitry also includes voltage-shifting circuitry 1200 presenting these digital inputs as signals relative to VNN' rather than GND.

Figure 13:
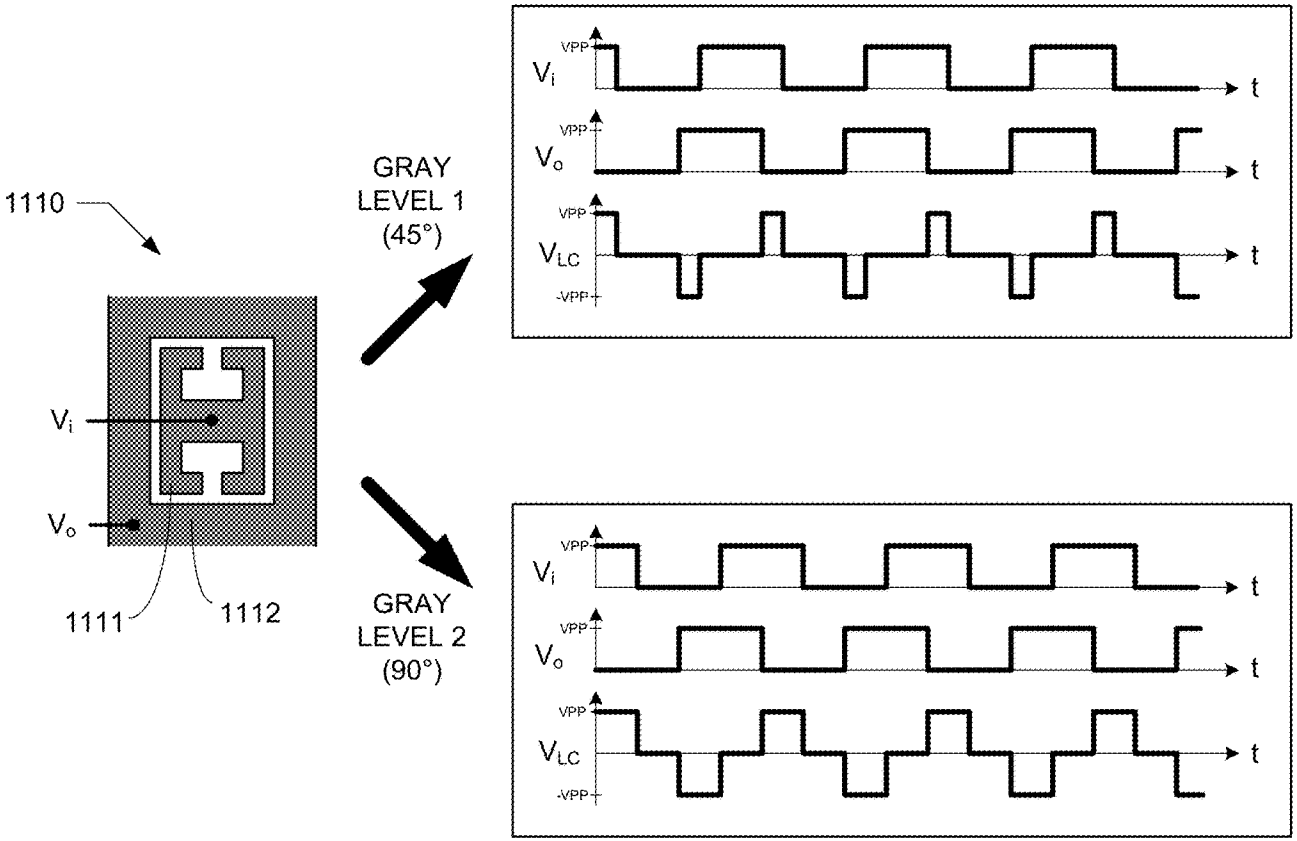

Exemplary waveforms for a grayscale voltage adjustment scheme are depicted in FIG. 13. In this grayscale scheme, a first square wave voltage $V_i$, is again applied to inner electrode 1111 of a unit cell 1110 and a second square wave voltage V° is again applied to outer electrode 1112 of the unit cell. A desired gray level is then achieved by selecting a phase difference between the two square waves. In one approach, as shown in FIG. 13, the drive period is divided into a discrete set of time slices corresponding to a discrete set of phase differences between the two square waves. In the nonlimiting example of FIG. 13, there are eight (8) time slices, providing five (5) gray levels corresponding to phase differences of 0°, 45°, 90°, 135°, and 180°. The figure depicts two gray level examples: for a phase difference of 45°, as shown in the upper right panel of the figure, the potential applied to the liquid crystal, $V_{LC}=V_i-V_o$, is an alternating pulse train with zero DC offset and an RMS voltage of VPP/4; for a phase difference of 90°, as shown in the lower right panel of the figure, $V_{LC}$ is an alternating pulse train with zero DC offset and an RMS voltage of VPP/2. Thus, the gray level scheme of FIG. 13 provides a pulse-width modulated (PWM) liquid crystal waveform with zero DC offset and an adjustable RMS voltage.

The drive circuitry of FIG. 11B may be used to provide the grayscale waveforms of FIG. 13 to a plurality of unit cells. However, for a grayscale implementation, an N-bit read-in is completed during each time slice of the drive period. Thus, for an implementation with T time slices (corresponding to (T/2)+1 gray levels), the serial input data is clocked at a frequency not less than T×N×f, where f is the drive frequency (it will be appreciated that T=2 corresponds to the binary drive scheme of FIG. 11A).

Figure 14:
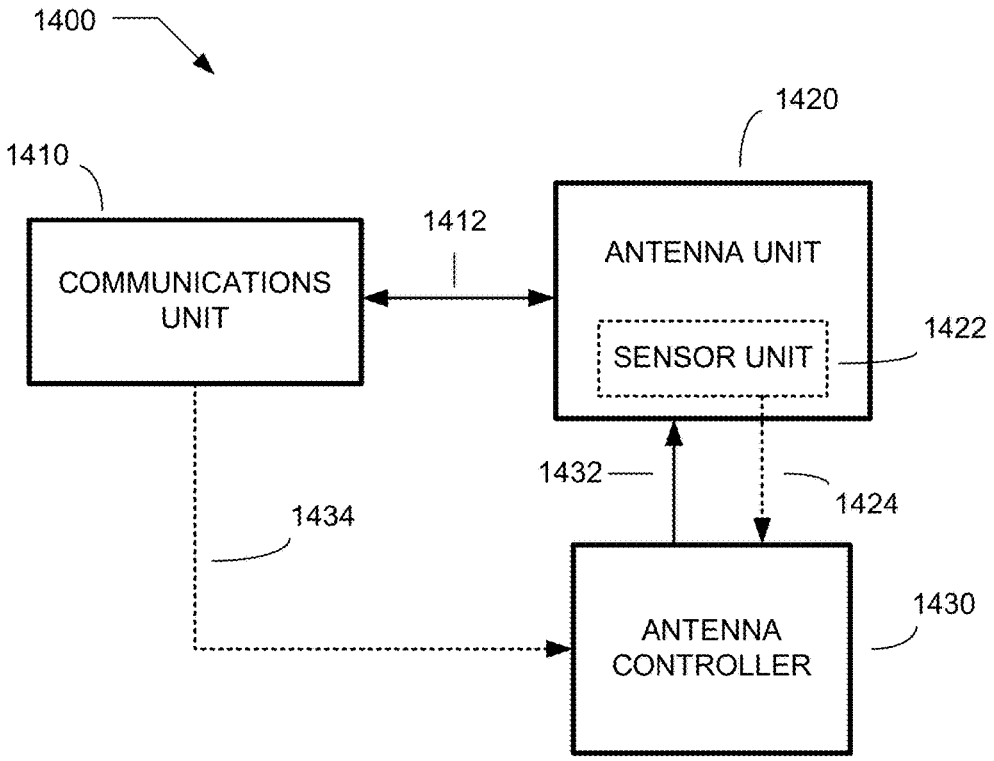
FIG. 14 depicts a system block diagram.

With reference now to FIG. 14, an illustrative embodiment is depicted as a system block diagram. The system 1400 include a communications unit 1410 coupled by one or more feeds 1412 to an antenna unit 1420. The communications unit 1410 might include, for example, a mobile broadband satellite transceiver, or a transmitter, receiver, or transceiver module for a radio or microwave communications system, and may incorporate data multiplexing/demultiplexing circuitry, encoder/decoder circuitry, modulator/demodulator circuitry, frequency upconverters/downconverters, filters, amplifiers, diplexes, etc. The antenna unit includes at least one surface scattering antenna, which may be configured to transmit, receive, or both; and in some approaches the antenna unit 1420 may comprise multiple surface scattering antennas, e.g. first and second surface scattering antennas respectively configured to transmit and receive. For embodiments having a surface scattering antenna with multiple feeds, the communications unit may include MIMO circuitry. The system 1400 also includes an antenna controller 1430 configured to provide control input(s) 1432 that determine the configuration of the antenna. For example, the control inputs(s) may include inputs for each of the scattering elements (e.g. for a direct addressing configuration such as depicted in FIG. 12), row and column inputs (e.g. for a matrix addressing configuration such as that depicted in FIG. 13), adjustable gains for the antenna feeds, etc.

In some approaches, the antenna controller 1430 includes circuitry configured to provide control input(s) 1432 that correspond to a selected or desired antenna radiation pattern. For example, the antenna controller 1430 may store a set of configurations of the surface scattering antenna, e.g. as a lookup table that maps a set of desired antenna radiation patterns (corresponding to various beam directions, beams widths, polarization states, etc. as discussed earlier in this disclosure) to a corresponding set of values for the control input(s) 1432. This lookup table may be previously computed, e.g. by performing full-wave simulations of the antenna for a range of values of the control input(s) or by placing the antenna in a test environment and measuring the antenna radiation patterns corresponding to a range of values of the control input(s). In some approaches the antenna controller may be configured to use this lookup table to calculate the control input(s) according to a regression analysis; for example, by interpolating values for the control input(s) between two antenna radiation patterns that are stored in the lookup table (e.g. to allow continuous beam steering when the lookup table only includes discrete increments of a beam steering angle). The antenna controller 1430 may alternatively be configured to dynamically calculate the control input(s) 1432 corresponding to a selected or desired antenna radiation pattern, e.g. by computing a holographic pattern corresponding to an interference term $\mathrm{Re}[\Psi_{out}\Psi_{in}]$ (as discussed earlier in this disclosure), or by computing the couplings $\{\alpha_j\}$ (corresponding to values of the control input(s)) that provide the selected or desired antenna radiation pattern in accordance with equation (1) presented earlier in this disclosure.

In some approaches the antenna unit 1420 optionally includes a sensor unit 1422 having sensor components that detect environmental conditions of the antenna (such as its position, orientation, temperature, mechanical deformation, etc.). The sensor components can include one or more GPS devices, gyroscopes, thermometers, strain gauges, etc., and the sensor unit may be coupled to the antenna controller to provide sensor data 1424 so that the control input(s) 1432 may be adjusted to compensate for translation or rotation of the antenna (e.g. if it is mounted on a mobile platform such as an aircraft) or for temperature drift, mechanical deformation, etc.

In some approaches the communications unit may provide feedback signal(s) 1434 to the antenna controller for feedback adjustment of the control input(s). For example, the communications unit may provide a bit error rate signal and the antenna controller may include feedback circuitry (e.g. DSP circuitry) that adjusts the antenna configuration to reduce the channel noise. Alternatively or additionally, for pointing or steering applications the communications unit may provide a beacon signal (e.g. from a satellite beacon) and the antenna controller may include feedback circuitry (e.g. pointing lock DSP circuitry for a mobile broadband satellite transceiver).

Figure 15:
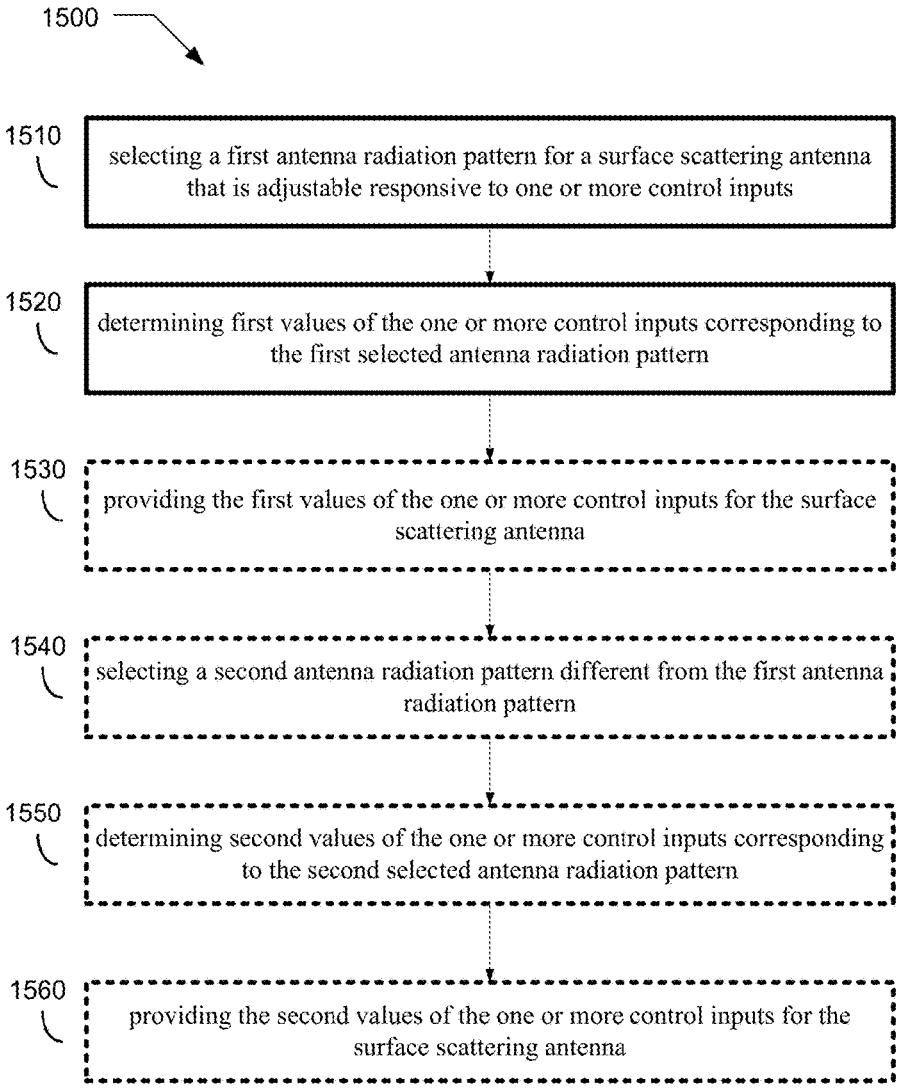
FIGS. 15 and 16 depict flow diagrams.

An illustrative embodiment is depicted as a process flow diagram in FIG. 15. Flow 1500 includes operation 1510—selecting a first antenna radiation pattern for a surface scattering antenna that is adjustable responsive to one or more control inputs. For example, an antenna radiation pattern may be selected that directs a primary beam of the radiation pattern at the location of a telecommunications satellite, a telecommunications base station, or a telecommunications mobile platform.

Alternatively or additionally, an antenna radiation pattern may be selected to place nulls of the radiation pattern at desired locations, e.g. for secure communications or to remove a noise source. Alternatively or additionally, an antenna radiation pattern may be selected to provide a desired polarization state, such as circular polarization (e.g. for Ka-band satellite communications) or linear polarization (e.g. for Ku-band satellite communications). Flow 1500 includes operation 1520—determining first values of the one or more control inputs corresponding to the first selected antenna radiation pattern. For example, in the system of FIG. 14, the antenna controller 1430 can include circuitry configured to determine values of the control inputs by using a lookup table, or by computing a hologram corresponding to the desired antenna radiation pattern. Flow 1500 optionally includes operation 1530—providing the first values of the one or more control inputs for the surface scattering antenna. For example, the antenna controller 1430 can apply bias voltages to the various scattering elements, and/or the antenna controller 1430 can adjust the gains of antenna feeds. Flow 1500 optionally includes operation 1540—selecting a second antenna radiation pattern different from the first antenna radiation pattern. Again this can include selecting, for example, a second beam direction or a second placement of nulls. In one application of this approach, a satellite communications terminal can switch between multiple satellites, e.g. to optimize capacity during peak loads, to switch to another satellite that may have entered service, or to switch from a primary satellite that has failed or is off-line. Flow 1500 optionally includes operation 1550—determining second values of the one or more control inputs corresponding to the second selected antenna radiation pattern. Again this can include, for example, using a lookup table or computing a holographic pattern. Flow 1500 optionally includes operation 1560—providing the second values of the one or more control inputs for the surface scattering antenna. Again this can include, for example, applying bias voltages and/or adjusting feed gains.

Figure 16:
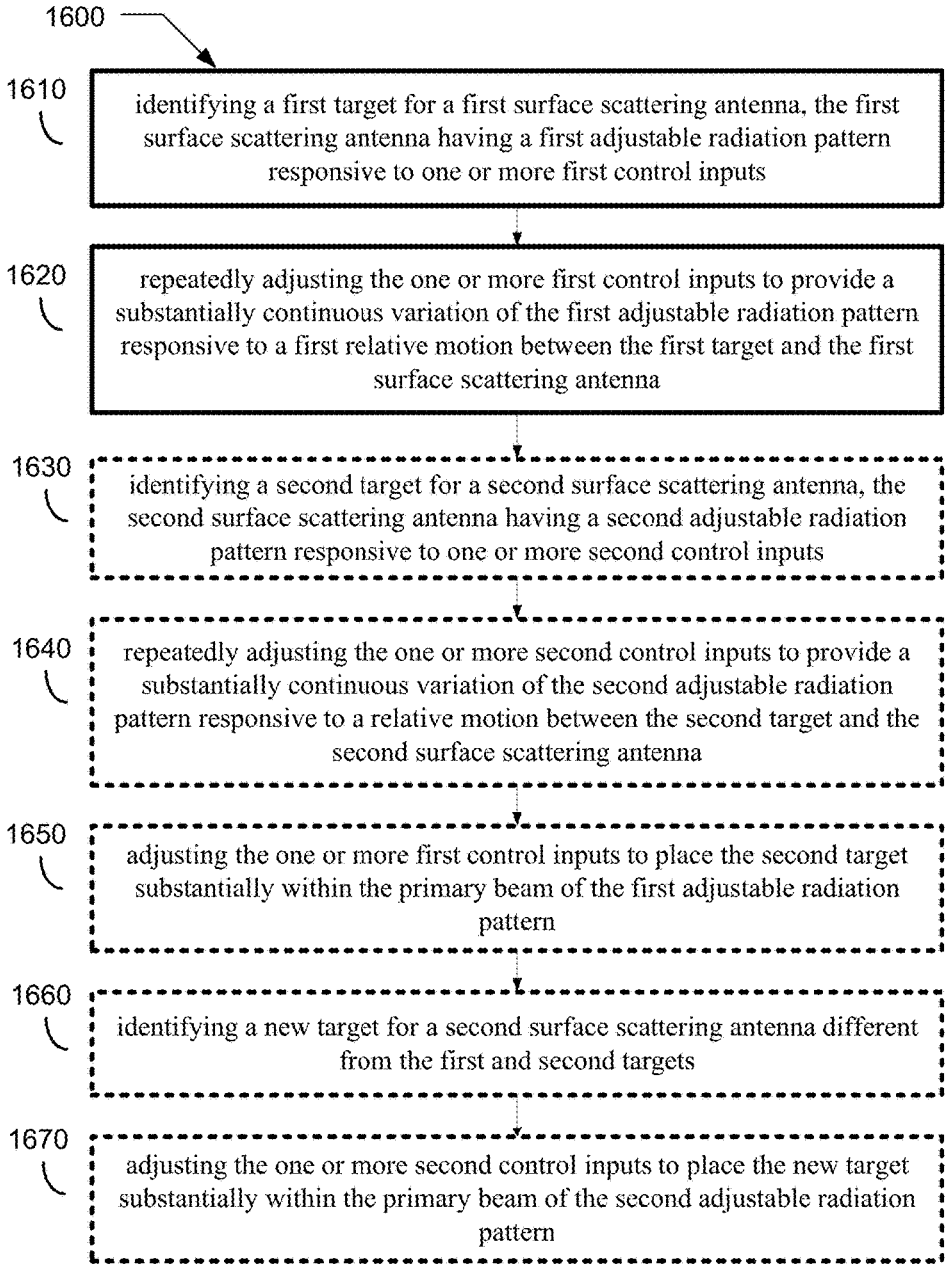

Another illustrative embodiment is depicted as a process flow diagram in FIG. 16. Flow 1600 includes operation 1610—identifying a first target for a first surface scattering antenna, the first surface scattering antenna having a first adjustable radiation pattern responsive to one or more first control inputs. This first target could be, for example, a telecommunications satellite, a telecommunications base station, or a telecommunications mobile platform. Flow 1600 includes operation 1620—repeatedly adjusting the one or more first control inputs to provide a substantially continuous variation of the first adjustable radiation pattern responsive to a first relative motion between the first target and the first surface scattering antenna. For example, in the system of FIG. 14, the antenna controller 1430 can include circuitry configured to steer a radiation pattern of the surface scattering antenna, e.g. to track the motion of a non-geostationary satellite, to maintain pointing lock with a geostationary satellite from a mobile platform (such as an airplane or other vehicle), or to maintain pointing lock when both the target and the antenna are moving. Flow 1600 optionally includes operation 1630—identifying a second target for a second surface scattering antenna, the second surface scattering antenna having a second adjustable radiation pattern responsive to one or more second control inputs; and flow 1600 optionally includes operation 1640—repeatedly adjusting the one or more second control inputs to provide a substantially continuous variation of the second adjustable radiation pattern responsive to a relative motion between the second target and the second surface scattering antenna. For example, some applications may deploy both a primary antenna unit, tracking a first object (such as a first non-geostationary satellite), and a secondary or auxiliary antenna unit, tracking a second object (such as a second non-geostationary satellite). In some approaches the auxiliary antenna unit may include a smaller-aperture antenna (tx and/or rx) primarily used to track the location of the secondary object (and optionally to secure a link to the secondary object at a reduced quality-of-service (QoS)). Flow 1600 optionally includes operation 1650—adjusting the one or more first control inputs to place the second target substantially within the primary beam of the first adjustable radiation pattern. For example, in an application in which the first and second antennas are components of a satellite communications terminal that interacts with a constellation of non-geostationary satellites, the first or primary antenna may track a first member of the satellite constellation until the first member approaches the horizon (or the first antenna suffers appreciable scan loss), at which time a "handoff" is accomplished by switching the first antenna to track the second member of the satellite constellation (which was being tracked by the second or auxiliary antenna). Flow 1600 optionally includes operation 1660—identifying a new target for a second surface scattering antenna different from the first and second targets; and flow 1600 optionally includes operation 1670—adjusting the one or more second control inputs to place the new target substantially within the primary beam of the second adjustable radiation pattern. For example, after the "handoff," the secondary or auxiliary antenna can initiate a link with a third member of the satellite constellation (e.g. as it rises above the horizon).

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna, comprising:

a waveguide; and a plurality of subwavelength elements distributed along the waveguide with inter-element spacings less than one-third of a free-space wavelength corresponding to an operating frequency of the antenna, where the plurality of subwavelength elements have a plurality of adjustable individual electromagnetic responses to a guided wave mode of the waveguide, and the plurality of adjustable individual electromagnetic responses provide an adjustable radiation field of the antenna;

wherein the waveguide includes a conducting surface, and the plurality of subwavelength elements corresponds to a plurality of conducting patches respectively positioned at least partially above a respective plurality of irises in the conducting surface; and wherein the plurality of conducting patches is configured to provide a plurality of individual radiation fields responsive to iris-intermediated couplings between the conducting patches and the guided wave mode.

2. The antenna of claim 1, wherein the operating frequency is a microwave frequency.

3. The antenna of claim 2, wherein the microwave frequency is a Ka or Ku band frequency.

4. The antenna of claim 2, wherein the microwave frequency is a Ku band frequency.

5. The antenna of claim 2, wherein the microwave frequency is a Q band frequency.

6. The antenna of claim 1, wherein the waveguide is a two-dimensional waveguide.

7. The antenna of claim 6, wherein the two-dimensional waveguide is a parallel plate waveguide and the conducting surface is an upper conductor of the parallel plate waveguide.

8. The antenna of claim 1, wherein the waveguide is a one-dimensional waveguide.

9. The antenna of claim 8, wherein the waveguide includes a closed waveguide and the conducting surface is an upper conductor of the closed waveguide.

10. The antenna of claim 1, wherein the waveguide includes a plurality of one-dimensional waveguides composing a two-dimensional antenna aperture.

11. The antenna of claim 10, wherein the plurality of one-dimensional waveguides is a plurality of closed waveguides and the conducting surface is one of a plurality of conducting surfaces that are respective upper conductors of closed waveguides.

12. The antenna of claim 1, wherein the irises are rectangular irises.

13. The antenna of claim 1, wherein the irises are slit-like irises.

14. The antenna of claim 1, wherein the conducting patches are rectangular patches.

15. The antenna of claim 1, further comprising:

a plurality of bias voltage lines configured to provide respective bias voltages between the plurality of conducting patches and the conducting surface.

16. An antenna, comprising:

a waveguide; and a plurality of subwavelength elements distributed along the waveguide with inter-element spacings less than one-third of a free-space wavelength corresponding to an operating frequency of the antenna, where the plurality of subwavelength elements are a plurality of subwavelength patch elements having a plurality of adjustable individual electromagnetic responses to a guided wave mode of the waveguide, and the plurality of adjustable individual electromagnetic responses provide an adjustable radiation field of the antenna;

where the plurality of subwavelength elements includes first and second subsets of subwavelength elements having radiation patterns that are substantially orthogonal.

17. The antenna of claim 16, wherein the first and second subsets of subwavelength elements have radiation patterns that are substantially linearly polarized and substantially orthogonal.

18. The antenna of claim 16, wherein the first and second subsets of subwavelength elements are first and second subsets of subwavelength elements that are perpendicularly oriented.

19. The antenna of claim 18, wherein the first and second subsets of subwavelength elements are perpendicularly oriented on a surface on the waveguide.

20. The antenna of claim 16, wherein the first and second subsets of subwavelength elements are adjusted so that the adjustable radiation field of the antenna is a linearly-polarized radiation field.

21. The antenna of claim 16, wherein the first and second subsets of subwavelength elements are adjusted so that the adjustable radiation field of the antenna is a circularly-polarized radiation field.

22. The antenna of claim 16, wherein the first and second subsets of subwavelength elements are adjusted so that the adjustable radiation field of the antenna is an elliptically-polarized radiation field.

23. The antenna of claim 16, wherein the first subset of subwavelength elements is a subset of subwavelength elements oriented at about +45° with respect to a propagation direction of the waveguide, and the second subset of subwavelength elements is a subset of subwavelength elements oriented at about −45° with respect to the propagation direction of the waveguide.

24. An antenna, comprising:

a waveguide; and a plurality of subwavelength patch elements distributed along the waveguide with inter-element spacings less than one-third of a free-space wavelength corresponding to an operating frequency of the antenna, where the plurality of subwavelength patch elements have a plurality of adjustable individual electromagnetic responses to a guided wave mode of the waveguide, and the plurality of adjustable individual electromagnetic responses provide an adjustable radiation field of the antenna;

wherein the waveguide includes a conducting surface, and the plurality of subwavelength elements corresponds to a plurality of conducting patches respectively positioned at least partially above a respective plurality of irises in the conducting surface; and wherein the antenna further comprises:

a plurality of biasing circuits configured to provide respective bias voltages between the plurality of conducting patches and the conducting surface;

a set of row control lines each addressing a row of the plurality of biasing circuits; and a set of column control lines each addressing a column of the plurality of biasing circuits.

25. The antenna of claim 24, wherein the subwavelength patch elements are arranged in rows and columns.

26. The antenna of claim 24, wherein each of the plurality of biasing circuits includes a switching device.

27. The antenna of claim 26, wherein the switching device is a transistor.

28. The antenna of claim 27, wherein the transistor is a thin-film transistor (TFT).

29. The antenna of claim 24, wherein the plurality of biasing circuits includes a plurality of circuits mounted on the waveguide with a surface mount technology (SMT).

30. The antenna of claim 24, wherein the biasing circuits configured to provide respective bias voltages are biasing circuits configured to provide respective AC bias voltages.

31. The antenna of claim 30, wherein the respective AC bias voltages have minimal or zero DC offset.

32. The antenna of claim 30, wherein the biasing circuits configured to provide AC bias voltages are biasing circuits configured to provide AC bias voltages with adjustable RMS voltage levels.

33. The antenna of claim 30, wherein the biasing circuits configured to provide AC bias voltages are biasing circuits configured to provide AC bias voltages with adjustable amplitudes.

34. The antenna of claim 30, wherein the biasing circuits configured to provide AC bias voltages are biasing circuits configured to provide AC bias voltages with adjustable pulse widths.

* * * * *